US012507772B2

(12) United States Patent
Ma

(10) Patent No.: US 12,507,772 B2
(45) Date of Patent: Dec. 30, 2025

(54) UMBRELLA ASSEMBLY WITH GAS SPRING

(71) Applicant: Zhun-An Ma, Ningbo (CN)

(72) Inventor: Zhun-An Ma, Ningbo (CN)

( * ) Notice: Subject to any disclaimer, the term of this patent is extended or adjusted under 35 U.S.C. 154(b) by 192 days.

(21) Appl. No.: 18/052,028

(22) Filed: Nov. 2, 2022

(65) Prior Publication Data

US 2023/0270216 A1 Aug. 31, 2023

Related U.S. Application Data

(60) Provisional application No. 63/264,026, filed on Nov. 12, 2021.

(51) Int. Cl.

| | |
|---|---|
| ***A45B 25/02*** | (2006.01) |
| ***A45B 25/14*** | (2006.01) |
| ***A45B 25/18*** | (2006.01) |

(52) U.S. Cl.
CPC ..... *A45B 25/02* (2013.01); *A45B 25/14* (2013.01); *A45B 25/18* (2013.01)

(58) Field of Classification Search
CPC ..... A45B 25/02; A45B 25/14; A45B 25/18
See application file for complete search history.

(56) References Cited

U.S. PATENT DOCUMENTS

| | | | | |
|---|---|---|---|---|
| 593,726 | A | 11/1897 | Nicholls | |
| 680,661 | A * | 8/1901 | Hunt | A45B 25/16 135/24 |
| 835,306 | A | 11/1906 | Mangelsdorf | |
| 878,270 | A | 2/1908 | Blake et al. | |
| 956,657 | A | 5/1910 | Wetteroth | |
| 957,528 | A | 5/1910 | Wetteroth | |
| D45,227 | S | 2/1914 | Glauber | |
| 1,136,887 | A | 4/1915 | Penn | |
| 1,235,296 | A | 7/1917 | Dillingham | |

(Continued)

FOREIGN PATENT DOCUMENTS

| | | |
|---|---|---|
| AT | 128258 | 5/1932 |
| BG | 6965-0001 | 4/2009 |

(Continued)

OTHER PUBLICATIONS

Operation Manual Easy Sun Parasol Sunshade (Issue: Jul. 2004) pp. 1-17.

(Continued)

*Primary Examiner* — Noah Chandler Hawk
(74) *Attorney, Agent, or Firm* — Knobbe, Martens, Olson & Bear, LLP

(57) ABSTRACT

An umbrella is provided that includes a hollow pole, a shade assembly, and a lift assembly. The shade assembly is coupled with an upper portion of the hollow pole. The shade assembly includes an upper hub, a lower hub, and a shade structure coupling the upper hub to the lower hub. The shade structure supports a shade member and the lower hub is moveable along the hollow pole. The lift assembly is disposed within the hollow pole. The lift assembly includes a gas spring and a cord. The cord has a first end coupled with the hollow pole and a second end coupled with the lower hub. When closing the umbrella, the cord applies a load to compress the gas spring. When opening the umbrella, the gas spring applies a load to the cord, to cause the lower hub to be moved upward.

24 Claims, 16 Drawing Sheets

(56) References Cited

U.S. PATENT DOCUMENTS 1,243,594 A 10/1917 Dillingham
1,255,627 A 2/1918 Morrow et al.
1,268,354 A 6/1918 Howard
1,801,913 A 4/1931 Frederick
1,881,990 A 10/1932 Zitzer
D90,772 S 9/1933 Kasch
1,972,653 A 9/1934 Hart
2,013,192 A 9/1935 Sidney
2,223,253 A 11/1940 Hamilton
D127,735 S 6/1941 Dreyfuss
2,341,399 A 2/1944 Timblin
2,447,972 A 8/1948 Weinert
2,462,560 A 2/1949 Schmidt
2,475,406 A 7/1949 Russell
D162,678 S 3/1951 Muller-Munk
D167,619 S 9/1952 Coran
2,661,012 A 12/1953 Militano
2,719,688 A 10/1955 Seifert
2,721,569 A 10/1955 Militano
2,745,421 A 5/1956 Russell
2,762,383 A 9/1956 Wittman
2,819,725 A 1/1958 Deisenroth et al.
RE24,477 E * 5/1958 Small ..... A45B 25/14 135/20.3
D183,609 S 9/1958 Higgins
2,932,047 A 4/1960 Johnston
2,937,653 A 5/1960 Danciart et al.
D190,597 S 6/1961 Nelson
3,120,238 A 2/1964 Glatz
3,129,715 A 4/1964 Militano
3,142,307 A 7/1964 Danciart et al.
3,145,720 A 8/1964 Torii
3,171,418 A 3/1965 Meyer
3,175,568 A 3/1965 Kafka
3,177,882 A 4/1965 Militano
3,177,883 A 4/1965 Militano
3,253,310 A 5/1966 McCarthy
3,279,835 A 10/1966 Krohm
3,311,119 A 3/1967 Pearlstine
3,347,575 A 10/1967 Morris
3,395,717 A 8/1968 Weber
3,424,180 A 1/1969 Giancarlo
3,457,931 A 7/1969 Yoshio
3,521,651 A 7/1970 Pearlstine
D221,039 S 6/1971 Zimmerman
3,683,948 A 8/1972 Cohen
3,802,452 A 4/1974 Weber
3,856,032 A 12/1974 Schafer
D234,729 S 4/1975 Weber et al.
4,252,137 A * 2/1981 Cohen ..... A61H 3/02 135/69
D265,498 S 7/1982 Paul
4,368,749 A 1/1983 Lindler et al.
4,385,849 A 5/1983 Crain
D276,838 S 12/1984 Hill et al.
4,586,525 A 5/1986 Glatz et al.
4,622,987 A 11/1986 Redl et al.
4,674,523 A 6/1987 Glatz
4,807,655 A 2/1989 Robertson
4,811,670 A 3/1989 Kolvites et al.
4,829,857 A 5/1989 Jones
4,878,509 A 11/1989 Tung
4,911,573 A 3/1990 Pietro
4,928,718 A * 5/1990 Apple ..... A45B 25/16 135/22
4,993,445 A 2/1991 Dubinsky
5,002,081 A 3/1991 Stromeyer
5,020,557 A 6/1991 Apple
5,029,596 A 7/1991 Tung
5,050,627 A 9/1991 Hengtzu
5,174,319 A 12/1992 Chou et al.
5,186,197 A 2/1993 Lavine
5,284,171 A 2/1994 Liu
D344,786 S 3/1994 Short et al.
5,333,824 A 8/1994 Dubinsky
5,349,975 A 9/1994 Valdner
5,355,903 A 10/1994 Haddad et al.
5,357,994 A 10/1994 Chung
D366,826 S 2/1996 Heithaus
5,499,644 A 3/1996 Geniele
D372,854 S 8/1996 Jimenez
5,584,564 A 12/1996 Phyle
5,588,455 A 12/1996 Kuo
5,611,364 A 3/1997 Woods et al.
5,615,698 A 4/1997 Ko
5,617,888 A 4/1997 Wu
5,640,984 A 6/1997 Dubunsky
5,651,732 A 7/1997 Dufour
5,655,557 A 8/1997 Martin
5,740,823 A 4/1998 Lin et al.
5,740,824 A 4/1998 Tang
5,749,386 A 5/1998 Samuel, Jr.
5,779,386 A 7/1998 Eichhorn
5,785,069 A 7/1998 Glatz
D397,054 S 8/1998 Brantley et al.
D398,443 S 9/1998 Bolle
5,809,734 A 9/1998 Turner
5,816,276 A 10/1998 Seidel et al.
D400,777 S 11/1998 Carsello
5,836,328 A 11/1998 Lee
5,871,024 A 2/1999 Vanderminden, Sr.
5,884,645 A 3/1999 Chen et al.
D408,621 S 4/1999 Kuo
5,899,210 A 5/1999 Letherby et al.
D410,862 S 6/1999 Milhov
5,921,115 A 7/1999 Winner
5,937,882 A 8/1999 Harbaugh
6,014,980 A 1/2000 Glatz
D424,799 S 5/2000 Lai
6,082,383 A 7/2000 Wilson
6,129,101 A 10/2000 Dubinsky
D434,215 S 11/2000 Lin
D434,476 S 11/2000 Meda
6,145,523 A 11/2000 Lo
6,152,156 A 11/2000 Tung
D434,556 S 12/2000 Lin
6,170,497 B1 * 1/2001 Ma ..... A45B 25/14 135/15.1
6,192,907 B1 2/2001 Wu
6,216,712 B1 4/2001 Lin et al.
6,220,261 B1 4/2001 Glatz
6,230,728 B1 5/2001 Reese
6,247,483 B1 6/2001 Rung
6,305,394 B1 10/2001 Reese
6,311,705 B1 11/2001 Ma
6,311,707 B1 11/2001 Wu et al.
6,314,976 B1 11/2001 Clarke
6,345,639 B2 2/2002 Rousselle et al.
6,371,141 B1 4/2002 Lin et al.
6,371,686 B1 4/2002 Wu
6,374,840 B1 4/2002 Ma
6,386,214 B1 5/2002 Clarke
6,386,215 B1 5/2002 Chang
D458,904 S 6/2002 Montena
6,412,506 B1 7/2002 Reese
6,422,251 B1 7/2002 Tseng
6,446,650 B1 9/2002 Ma
6,478,037 B2 11/2002 Tung
6,516,820 B1 2/2003 Earnshaw
6,571,813 B2 6/2003 Lin et al.
6,575,182 B2 6/2003 Tung
6,575,183 B2 6/2003 Tung
D477,458 S 7/2003 Goldwitz
6,588,438 B1 7/2003 Steiner
6,595,713 B1 7/2003 Wilson
D478,416 S 8/2003 Clarke
6,619,306 B2 9/2003 Ma
6,662,815 B2 12/2003 Tung
D484,680 S 1/2004 You
D489,169 S 5/2004 You
D489,170 S 5/2004 You
D489,967 S 5/2004 Funk
6,732,753 B2 5/2004 Chang
6,758,229 B2 7/2004 Wang

(56) References Cited

U.S. PATENT DOCUMENTS

D497,478 S 10/2004 Clarke
D497,479 S 10/2004 Yu
6,810,895 B2 11/2004 Lin et al.
6,837,255 B2 1/2005 Bunch et al.
6,848,459 B2 2/2005 Ma
6,851,823 B2 2/2005 Bilotti
D503,035 S 3/2005 Ko
6,889,699 B2 5/2005 Clarke
6,920,887 B2 7/2005 Lo
6,941,960 B2 9/2005 Huang
D515,803 S 2/2006 You
7,000,624 B2 2/2006 Chang
D525,721 S 7/2006 Landes
7,082,953 B2 8/2006 Liu
7,089,950 B2 8/2006 Lin
D532,947 S 11/2006 Muscarella
7,182,713 B2 2/2007 Wang
D539,632 S 4/2007 Ma
7,204,261 B1 * 4/2007 Wu ..... A45B 25/06 135/25.1
7,255,118 B2 8/2007 Ma
7,281,542 B2 10/2007 Ko
D555,349 S 11/2007 You
7,293,573 B2 11/2007 Clarke
D558,444 S 1/2008 Ma
7,318,444 B2 1/2008 Clakre
7,328,715 B2 2/2008 Neubardt
7,412,985 B2 8/2008 Ma
D586,549 S 2/2009 Hermanson et al.
D586,550 S 2/2009 Hermanson et al.
D587,448 S 3/2009 You
7,546,845 B2 6/2009 Prusmack
D600,439 S 9/2009 Zonsius
7,600,734 B2 10/2009 Clarke
7,665,477 B1 2/2010 Hathaway
7,686,024 B1 3/2010 Lai
7,703,464 B2 4/2010 Ma
7,775,226 B2 8/2010 MacDonald et al.
7,806,130 B2 10/2010 Gobel
D631,243 S 1/2011 Forthuber et al.
7,861,734 B2 1/2011 Ma
7,891,367 B2 2/2011 Ma
7,900,643 B2 3/2011 Ma
7,913,708 B2 3/2011 Yung
7,913,709 B2 3/2011 Brebner
D637,388 S 5/2011 You
D640,464 S 6/2011 Forthuber et al.
7,980,262 B1 7/2011 You
8,020,572 B2 9/2011 Ma
8,053,042 B1 11/2011 Loomis
8,061,375 B2 11/2011 Ma
D650,984 S 12/2011 Pineda
8,082,935 B2 12/2011 Ma
8,087,420 B1 * 1/2012 Lukacsy ..... A45B 25/16 135/22
8,096,310 B2 1/2012 Clarke
8,100,139 B2 1/2012 Chong
D664,760 S 8/2012 Elder
8,272,391 B2 9/2012 Luo
8,298,633 B1 10/2012 Chen
8,443,819 B2 5/2013 Beaulieu
8,522,804 B1 9/2013 Tung
D704,044 S 5/2014 Makino
8,757,183 B2 6/2014 Volin
D714,132 S 9/2014 Hazantonis
8,899,250 B1 12/2014 Tung
D727,469 S 4/2015 Jorgensen
9,004,087 B2 4/2015 Ma
D731,166 S 6/2015 Ma
9,060,576 B2 * 6/2015 Siegenthaler ..... A45B 25/06
9,113,683 B2 8/2015 Ma
D753,271 S 4/2016 LaBarbera et al.
D759,955 S 6/2016 Ma
D759,956 S 6/2016 McQuaid
9,504,298 B2 11/2016 Li
9,844,288 B2 12/2017 Fu
D818,697 S 5/2018 Ma
10,016,033 B2 7/2018 Volin
10,562,172 B1 2/2020 Armstrong
10,736,390 B2 8/2020 Ma
10,758,015 B2 9/2020 Ma
10,945,381 B1 3/2021 Pringnitz
11,123,857 B1 9/2021 Ramsey
11,206,903 B2 12/2021 Ma
11,388,963 B2 7/2022 Ma
11,771,186 B2 10/2023 Ma
D1,003,592 S 11/2023 Ma
12,167,782 B2 12/2024 Ma
12,207,714 B2 1/2025 Ma
12,262,801 B2 4/2025 Ma
12,317,977 B2 6/2025 Ma
2001/0017150 A1 8/2001 Doreste
2002/0083969 A1 7/2002 Tung
2002/0139405 A1 10/2002 Lee
2003/0010367 A1 1/2003 Ko
2003/0015230 A1 1/2003 Glatz
2003/0062073 A1 4/2003 Tung
2004/0031513 A1 2/2004 Bunch et al.
2004/0055627 A1 3/2004 P. Moga
2004/0055628 A1 3/2004 Yu
2004/0069333 A1 4/2004 Ma
2004/0154525 A1 8/2004 Wirth et al.
2004/0182429 A1 9/2004 Chen
2004/0187900 A1 9/2004 Earnshaw
2004/0206382 A1 10/2004 Clarke
2004/0206383 A1 10/2004 Clarke
2005/0045217 A1 * 3/2005 Clarke ..... A45B 19/04 135/20.3
2005/0081902 A1 4/2005 Liu
2005/0098200 A1 5/2005 Su
2005/0238422 A1 10/2005 Hung
2005/0279520 A1 12/2005 Newman et al.
2006/0005867 A1 1/2006 Chang
2006/0005868 A1 * 1/2006 Fenton ..... A45B 25/00 135/33.4
2006/0046899 A1 3/2006 Wang
2006/0070644 A1 4/2006 Schneller
2006/0151018 A1 7/2006 Wilson
2006/0151019 A1 7/2006 Lo
2007/0113878 A1 5/2007 Ko
2007/0261728 A1 11/2007 Lin
2008/0041433 A1 2/2008 Caldwell
2008/0053498 A1 3/2008 Liu et al.
2008/0202570 A1 8/2008 Clarke
2009/0126769 A1 5/2009 Hoogendoorn
2009/0242065 A1 10/2009 Whitling et al.
2010/0139724 A1 6/2010 Lai
2010/0139725 A1 6/2010 Lai
2011/0061694 A1 3/2011 Vanderminden, Sr.
2011/0132418 A1 6/2011 Ma
2011/0209732 A1 9/2011 Ma
2011/0214705 A1 9/2011 Ma
2011/0241389 A1 10/2011 Tsai
2011/0277800 A1 11/2011 Tung
2012/0126533 A1 5/2012 Canale
2012/0155958 A1 6/2012 Donohue
2014/0109942 A1 4/2014 Ma
2014/0305476 A1 10/2014 Ma
2014/0376990 A1 12/2014 Lai
2015/0237976 A1 8/2015 Chow
2019/0082802 A1 3/2019 Ma
2019/0203497 A1 * 7/2019 Mummert ..... A45B 25/06
2019/0323531 A1 10/2019 Wang
2020/0297085 A1 9/2020 Ma
2020/0384328 A1 12/2020 Chua
2021/0112932 A1 4/2021 Ma
2022/0125169 A1 4/2022 Ma
2022/0265013 A1 8/2022 Ma

(56) References Cited

U.S. PATENT DOCUMENTS

| | | | |
|---|---|---|---|
| 2022/0400822 | A1 | 12/2022 | Ma |
| 2023/0018195 | A1 | 1/2023 | Ma |
| 2025/0064181 | A1 | 2/2025 | Ma |

FOREIGN PATENT DOCUMENTS

| | | | |
|---|---|---|---|
| CN | 2579212 | | 10/2003 |
| CN | 202060155 | | 12/2011 |
| CN | 202190859 | | 4/2012 |
| CN | 202588579 | | 12/2012 |
| CN | 202636818 | | 1/2013 |
| CN | 203168230 | | 9/2013 |
| CN | 204181115 | | 3/2015 |
| CN | 106889721 | | 4/2017 |
| CN | 208280719 | | 12/2018 |
| CN | 210581325 | | 5/2020 |
| CN | 211229881 | | 8/2020 |
| DE | 22 04 217 | | 8/1973 |
| DE | 24 34 495 | | 2/1975 |
| DE | 3820573 | | 8/1989 |
| DE | 29516009 | | 11/1995 |
| DE | 202010011240 | | 11/2010 |
| DE | 202012007364 | | 11/2012 |
| DE | 202017002887 | | 7/2017 |
| DE | 202019103816 | | 7/2019 |
| EA | 007772157-0001 | | 3/2020 |
| EP | 0 628 264 | | 12/1994 |
| EP | 1 302 120 | | 3/2005 |
| EP | 1 510 145 | | 3/2005 |
| EP | 2 289 364 | | 3/2011 |
| EP | 4 118 998 | | 1/2023 |
| FR | 2612551 | | 9/1988 |
| FR | 2672781 | A3 | 8/1992 |
| JP | 58-107024 | | 7/1983 |
| JP | S61-37814 | | 3/1986 |
| JP | H08-322621 | | 12/1996 |
| JP | 2000-139533 | | 5/2000 |
| JP | 2001-046131 | | 2/2001 |
| JP | 2006-110317 | A | 4/2006 |
| JP | 2007-222591 | | 9/2007 |
| JP | 2008-142310 | | 6/2008 |
| JP | 3144314 | | 7/2008 |
| JP | 2009-045359 | | 3/2009 |
| JP | 2009-247750 | | 10/2009 |
| WO | WO 2005/058089 | | 6/2005 |
| WO | WO 2007/092514 | | 8/2007 |
| WO | WO 2013/013474 | | 1/2013 |
| WO | WO 2018/084181 | | 5/2018 |

OTHER PUBLICATIONS

Amazon.com, Site visited Feb. 7, 2023, ITT AHO Heavy Duty Telescoping Extension Pole, First available Dec. 21, 2019, https://us.amazon .com/ITTAHO-Aluminum-Telescopic-Extension-Telescoping/dp/B07ZT8M9VD (Year: 2019).

Shadeaustralia.com.au, Site visited Jan. 23, 2023, Shelta Como Umbrella, oldest review dated Dec. 7, 2017, https://www.shadeaustralia.com.au/como-timber-umbrella (Year: 2017).

Youtube.com, Site visited Jan. 24, 2023, "Cool Pool Products Umbrella Sleeve," published on Jul. 19, 2019 by CoolPoolProducts: https:// www .youtube.com/watch?v=x_qAK8QDJ Ko&list=TLGGy0td2PTduXUyNDAxMjAyMw (Year: 2019).

Youtube.com, Site visited Feb. 10, 2023, "Testrite Telescopic Tubing and Locks," published by Testrite on Sep. 26, 2017 features the FA Spring Button A-Clutch Lock: https://www.youtube.com/watch?v=Lp2uGtOGZRA (Year: 2017).

* cited by examiner

UMBRELLA ASSEMBLY WITH GAS SPRING

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

This application is directed to umbrella assemblies having an actuation assist mechanism, which can include a gas spring assembly configured to assist the opening and/or closing of the umbrella.

Description of the Related Art

Many umbrellas are opened and closed by pushing a runner up and down along a pole. The size and weight of the umbrella can make the opening and closing of the umbrella challenging. The shade member, ribs, and struts blocking access to the runner can make it difficult to apply the necessary force to the runner to open and close the umbrella.

SUMMARY

It can be challenging to apply sufficient force to open and close an umbrella due to obstacles caused by the umbrella itself, such as the shade member, ribs, and struts. Also, larger umbrellas can have a size and corresponding weight that make opening the umbrella by unassisted human force difficult. In view of the foregoing, improved umbrella assemblies incorporating lift assist or gas lift, e.g., gas spring, assemblies are needed. Such assemblies can be configured with fixed upper portions and displaceable lower portions that can store energy to help the umbrella transition from a closed configuration to an open configuration. Preferably these lift assist assemblies are retained within an umbrella pole assembly and can be actuated to store energy by movement of a lower hub without requiring an intermediate hub structure between an upper and a lower hub of a shade assembly.

In one embodiment, an umbrella is provided that includes a hollow pole, a shade assembly coupled with an upper portion of the hollow pole, an upper fixture disposed on the hollow pole, and a lift assist assembly disposed within the hollow pole. The shade assembly includes an upper hub, a lower hub, and a shade structure coupling the upper hub to the lower hub. The shade structure supports a shade member. The lower hub is moveable along the hollow pole. The upper fixture has a pulley and at least one ledge configured to interact with at least one hook pivotally coupled to the lower hub. The lift assist assembly includes a gas spring and a cord. The gas spring includes a hollow tube having an inner diameter, a piston having an outer diameter sized to fit within at least a portion of the hollow tube, a seal positioned between the inner diameter of the hollow tube and the outer diameter of the piston, and a lower fixture coupled to a lower end of the piston. The lower fixture including at least two spacers. The cord has a first end coupled with the hollow pole and a second end coupled with the lower hub. When closing the umbrella, the at least one hook disengages from the at least one ledge and the lower hub is moved downward and the cord applies a load to compress the gas spring by moving the piston into the hollow tube. Wherein when opening the umbrella the gas spring applies a load to the cord, to cause an upward load to be applied to the lower hub.

In some embodiments, the lower fixture comprises a core member and four spacers extending outward from the core member to outer edges. The outer edges of the spacers are configured to engage an inner wall of the hollow pole.

In some embodiments, the lower fixture comprises a pulley supported on a core member, the cord is disposed around the pulley.

In another embodiment, an umbrella is provided that includes a hollow pole, a shade assembly, a lift assist assembly, and a cord. The shade assembly is coupled with an upper portion of the hollow pole. The shade assembly includes an upper hub, a lower hub, a shade structure coupling the upper hub to the lower hub. The shade structure supports a shade member, e.g., when fully assembled. The lower hub is moveable along the hollow pole. The lift assist assembly is disposed within the hollow pole. The lift assist assembly includes a gas spring that comprises a hollow tube having an open interior and a piston disposed within the open interior of the hollow tube. The cord has a first end coupled with the hollow pole and a second end coupled with the lower hub. When closing the umbrella, the cord moves the piston into the hollow tube compressing a gas within the hollow tube and when opening the umbrella the gas spring applies a load to the cord, to cause the lower hub to be moved upward.

In some embodiments, the umbrella further includes a hook pivotably mounted in the lower hub. The hook configured to rest on a ledge of the hollow pole when the umbrella is open and to pivot away from the ledge to allow the umbrella to be closed. The pivoting of the hook being actuated by downward movement of a lower portion of a hub assembly including the lower hub relative to the lower hub. The hub assembly can include the lower hub and a handle coupled with the lower hub.

In some embodiments, the lower portion of the hub assembly further comprises a handle extending downward relative to an upper portion of the lower hub. The handle is moveable downward when the hook is resting on the ledge to pivot the hook away from the ledge to allow the lower hub to be lowered to allow the umbrella to be closed.

In some embodiments, the cord is disposed over a pulley coupled with the hollow pole and is tension by downward movement of the piston of the gas spring.

In some embodiments, the umbrella further includes a lower fixture coupled to a lower end of the piston, the lower fixture comprising at least one spacer, at least two spacers, at least three spacers, at least four spacers, and in some cases five or more spacers.

In some embodiments, the lower fixture further comprises a pulley and the cord is disposed around the pulley.

In another embodiment an umbrella is provided that includes a hollow pole, a shade assembly, and a lift assist assembly. The shade assembly is coupled with an upper portion of the hollow pole. The shade assembly including an upper hub, a lower hub, a shade structure coupling the upper hub to the lower hub. The shade structure supports a shade member, e.g., when fully assembled. The lower hub is moveable along the hollow pole. The lift assist assembly disposed within the hollow pole. The lift assist assembling including a gas spring and a cord that has a first end coupled with the hollow pole and a second end coupled with the lower hub. When closing the umbrella, the cord applies a load to compress the gas spring and when opening, the gas spring applies a load to the lower hub by way of the cord.

In some embodiments, the umbrella further includes a hook pivotably mounted in the lower hub. The hook configured to rest on a ledge of the hollow pole when the umbrella is open and to pivot away from the ledge to allow the umbrella to be closed. The pivoting of the hook being actuated by downward movement of a handle relative to an upper portion of the lower hub.

In some embodiments, the handle extends downward from a lower portion of the lower hub. The handle is moveable downward relative to an upper portion of the lower hub when the hook is resting on the ledge to pivot the hook away from the ledge to allow the lower hub to be lowered to allow the umbrella to be closed.

In some embodiments, the hook has a curved lower portion that is actuated by movement of a roller disposed in the handle.

In some embodiments, the cord is disposed over a pulley coupled with the hollow pole and is tension by downward movement of a lower end of the gas spring and/or downward movement of the lower hub.

In some embodiments, downward movement of the lower hub raises a lower end of the gas spring to compress the gas spring.

In some embodiments, the umbrella further includes an upper fixture disposed on the hollow pole. The upper fixture comprising a pulley and at least one ledge for a corresponding hook of the lower hub to interact with.

In some embodiments, the gas spring further includes a lower fixture comprising a central hub and a plurality of spacers, each spacer extending from the central hub to a free end.

In some embodiments, the lower fixture comprises a pulley, the cord being disposed around the pulley.

In some embodiments, the umbrella further includes a strap to retain the umbrella in a closed state.

In some embodiments, the gas spring further comprises a hollow tube and a piston sized to fit within the hollow tube.

In some embodiments, the gas spring further comprises a seal positioned between an inner diameter of the hollow tube and the outer diameter of the piston.

In some embodiments, the umbrella further includes an upper fixture disposed on the hollow pole. The upper fixture comprising a radial projection disposed on a lower portion. The lower hub comprising a radial recess disposed on an inner periphery of an upper portion. The radial projection configured to be disposed in the radial recess to limit rotation of the lower hub about the hollow pole.

In some embodiments, the upper fixture comprises a plurality of radial projections disposed on a lower portion. The lower hub comprising a plurality of radial recesses disposed on an inner periphery of an upper portion. The plurality of radial projections configured to be disposed in the plurality of radial recesses to limit rotation of the lower hub about the hollow pole.

In some embodiments, the umbrella further includes a cord guide member disposed about a hollow tube of a gas spring of the lift assist assembly. The cord guide member comprising a plurality of projections configured to slide along an inner surface of the hollow pole.

In another embodiment, an umbrella is provided that includes a hollow pole, and a shade assembly. The shade assembly is coupled with an upper portion of the hollow pole. The shade assembly includes an upper hub, a lower hub, a shade structure coupling the upper hub to the lower hub. The shade structure supports a shade member, e.g., when fully assembled. The lower hub is moveable along the hollow pole. A hook is pivotably mounted in the lower hub of a hub assembly including a handle. The hook configured to rest on a ledge of the pole assembly when the umbrella is open and to pivot away from the ledge to allow the umbrella to be closed. The pivoting of the hook is actuated by downward movement of the handle. The handle is moveable downward when the hook is resting on the ledge to pivot the hook away from the ledge to allow the lower hub to be lowered to allow the umbrella to be closed.

In variation of the foregoing embodiment, the hook includes an outwardly curved lower portion that can be actuated by an internal portion of the handle, such as a projection, roller, or other actuator.

In further variations, the umbrella includes a lift assist assembly and a cord. The lift assist assembly is disposed within the hollow pole. The lift assist assembly includes a gas spring that comprises a hollow tube having an open interior and a piston disposed within the open interior of the hollow tube. The cord has a first end coupled with the hollow pole and a second end coupled with the lower hub. When closing the umbrella, the cord moves the piston into the hollow tube, e.g., upward into the hollow tube, compressing a gas within the hollow tube and when opening the umbrella the gas spring applies a load to the cord, e.g., by the lower end of the piston moving downward relative to the hollow tube, to cause the lower hub to be moved upward.

The upper end of the hollow tube of the gas lifter can be fixed within the hollow pole. The upper end of the hollow tube can be fixed at a position at or adjacent to the ledge for securing the hook.

BRIEF DESCRIPTION OF THE DRAWINGS

Features of the invention can be better understood from the following detailed description when read in conjunction with the accompanying schematic drawings, which are for illustrative purposes only. The drawings include the following figures.

DETAILED DESCRIPTION

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

This application is directed to new umbrella assemblies that assist a user in actuating the umbrella, e.g., by providing an upward or downward directed force to reduce the amount of force needed in one or both of opening and closing the umbrella. In one embodiment, a gas spring is provided. The gas spring can be configured to provide an assist in the lifting of a lower hub of the umbrella, sometimes referred to herein as a lifter assist. Such assist is particularly useful in the opening of large umbrellas. These assemblies can be embodied in or operate with novel hub configurations and designs. A lift assembly with a hollow tube, a piston disposed at least partially within the hollow tube, a seal, and a cord facilitate movement of the lower hub when opening the umbrella as discussed in greater detail below. The gas spring can alternatively be used to assist in the closing of or in maintaining an umbrella closed.

Figure 1:
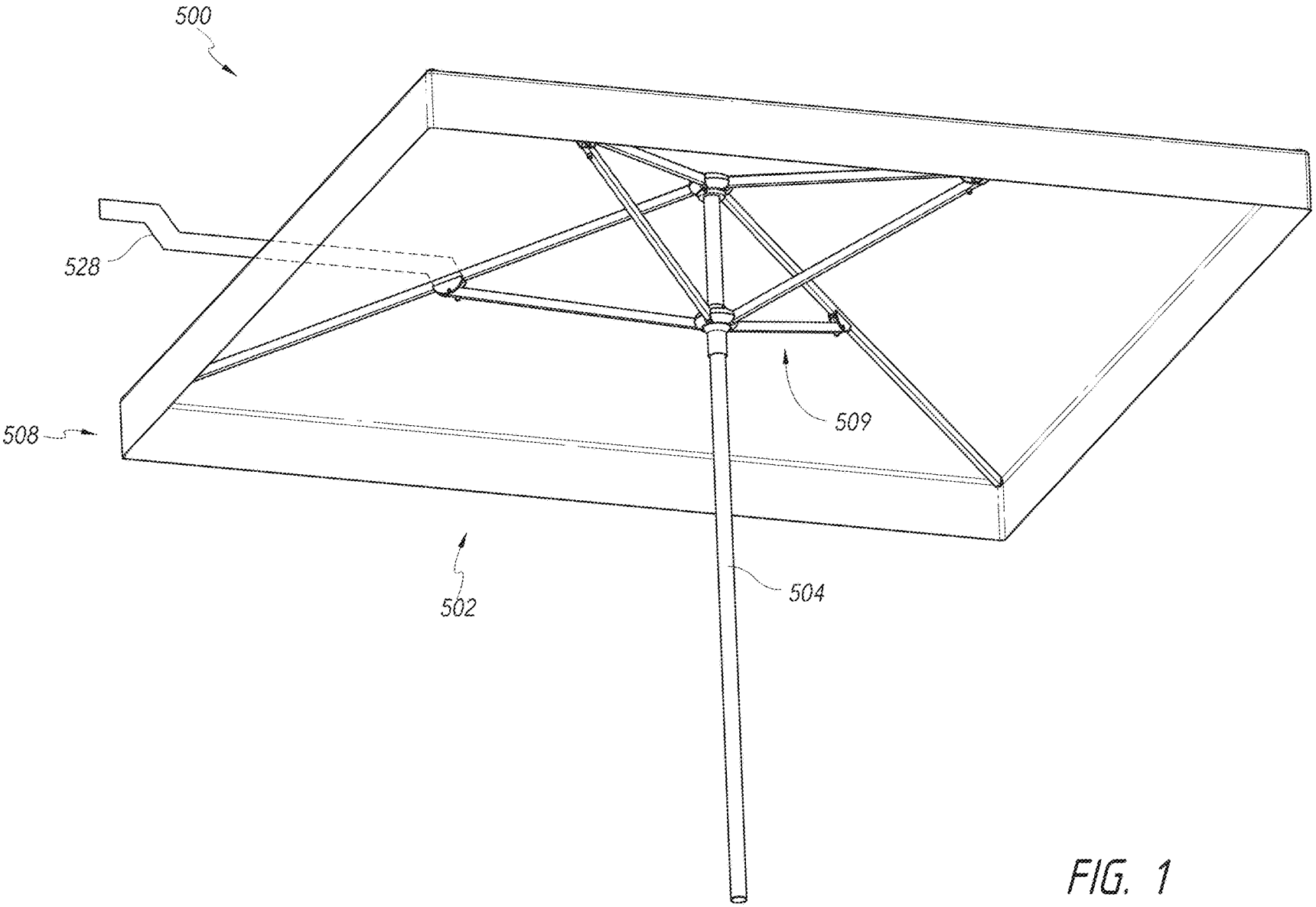
FIG. 1 is a bottom perspective view of an umbrella including a pole assembly, a shade member, an upper hub, and a lower hub.
Figure 2:
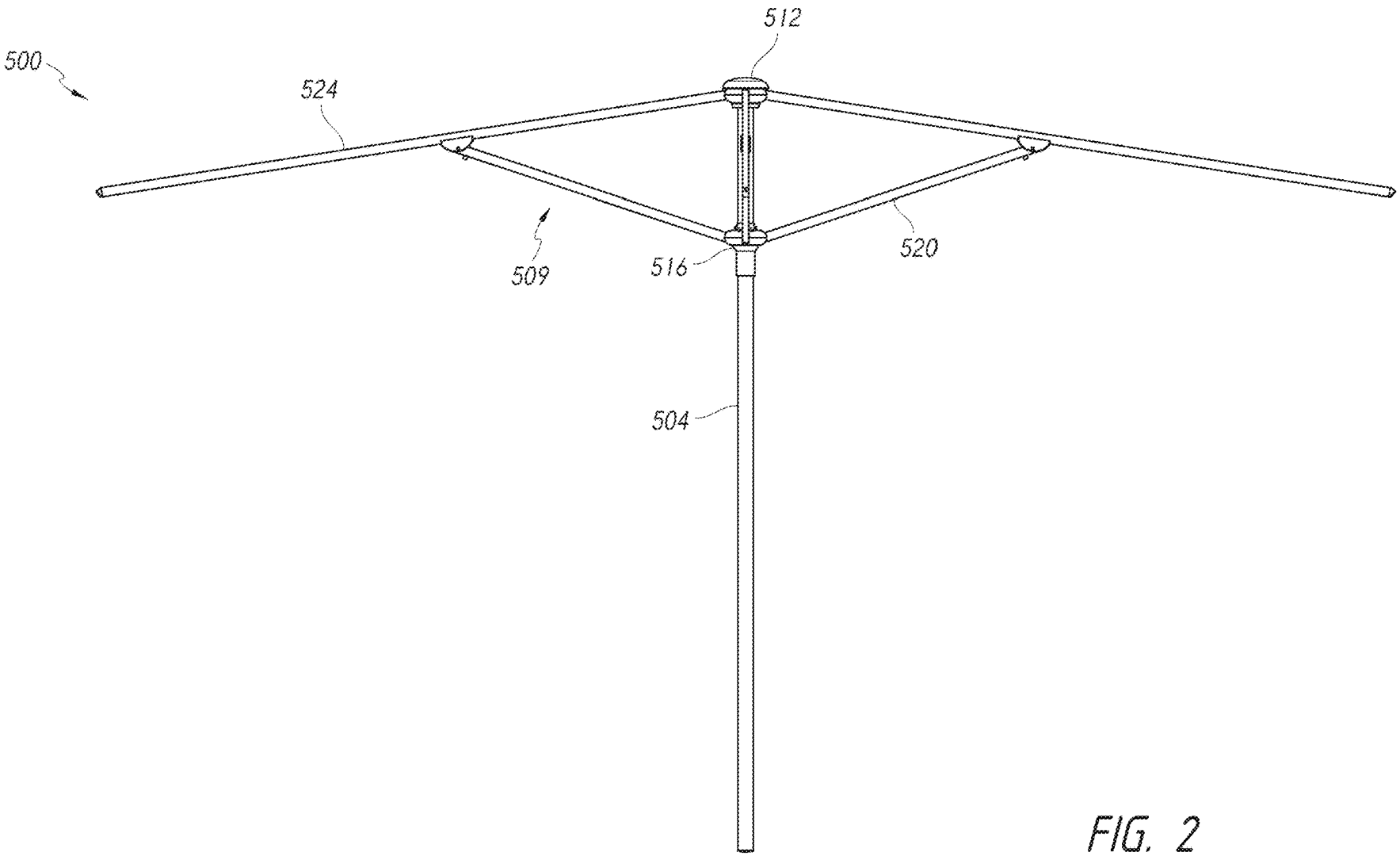
FIG. 2 is a plane view of the umbrella of FIG. 1 with the shade member removed showing the shade assembly and the pole assembly.

FIGS. 1 and 2 show an umbrella 500 including a hollow pole assembly 504 (also sometimes referred to herein as a hollow pole) and a shade assembly 502 having an upper hub 512, a lower hub 516, and a shade structure 509. The shade structure 509 can connect the lower hub 516 and the upper hub 512. The shade structure 509 can include ribs 524, struts 520. The shade assembly can include the shade structure 509 and a shade member 508. The ribs 524 are coupled at one end to the upper hub 512. The ribs 524 are coupled at a location along their length to one end of the corresponding struts 520. The end of the struts 520 that are not coupled to the ribs 524 are coupled to the lower hub 516. The umbrella 500 can be opened and closed by moving the lower hub 516 along the hollow pole assembly 504. The lower hub 516 can be moved in the upward direction to open the umbrella 500 and moved in the downward direction to close the umbrella 500. The umbrella 500 can include a strap 528 in one example to assist in keeping the umbrella 500 closed. A lower end of the hollow pole assembly 504 can be inserted into a weighted base or a fixture secured to or embedded in a ground surface.

Figure 3:
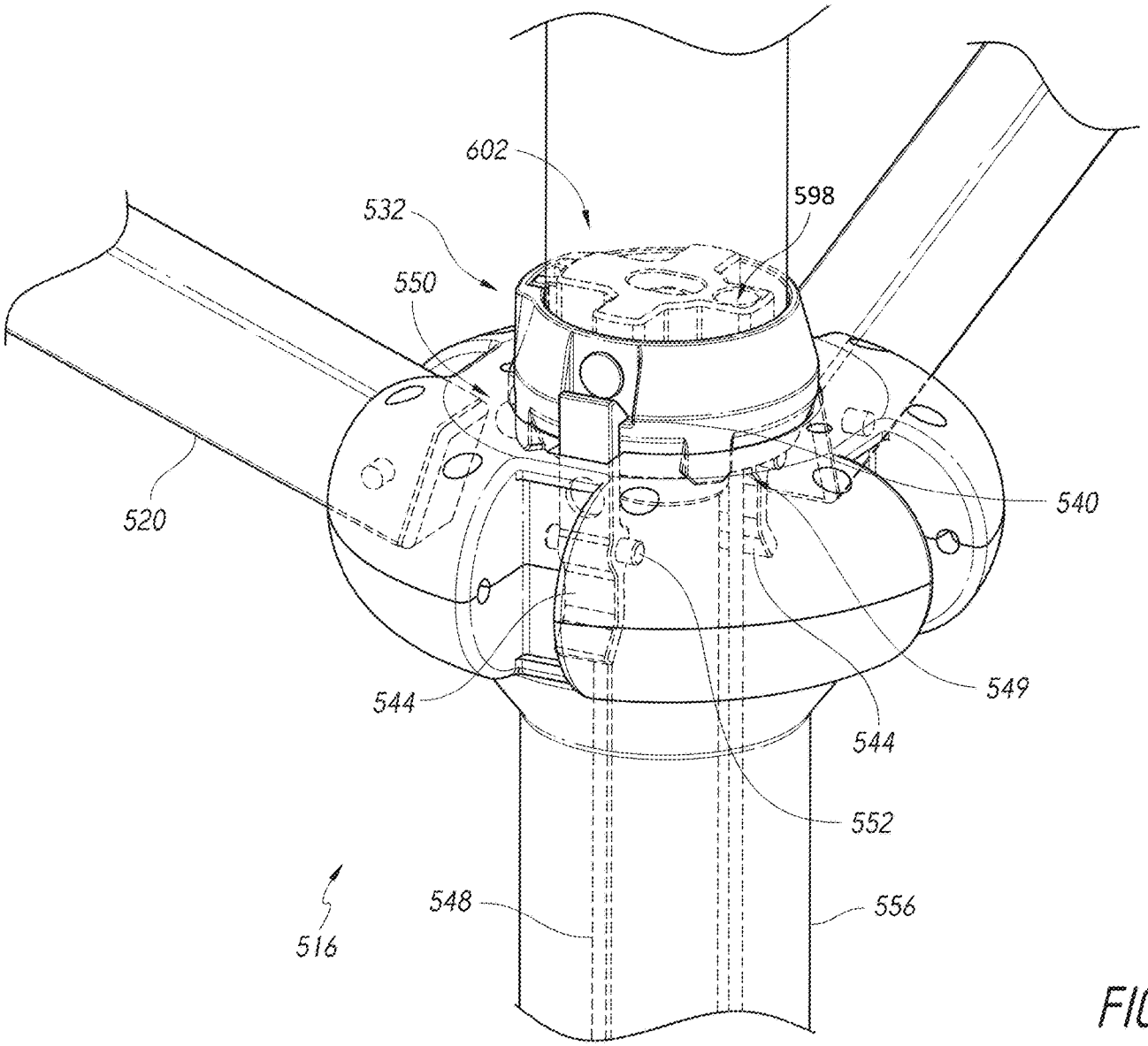
FIG. 3 is a top perspective view of the umbrella of FIG. 1 illustrating one embodiment of a lower hub including hooks pivotally connected to an upper fixture coupled with the pole assembly, two struts having been removed to show the hub structure more clearly.
Figure 4:
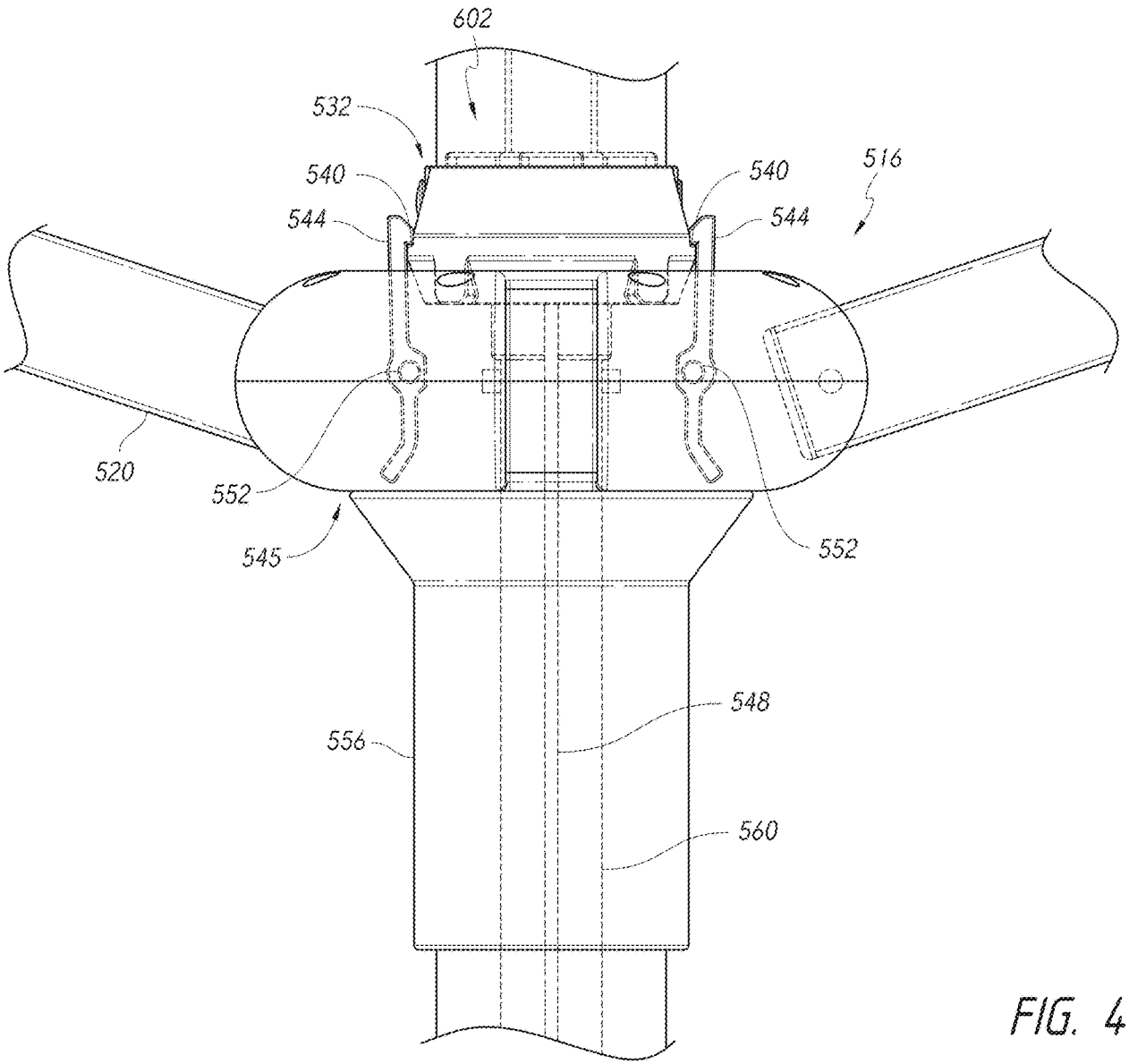
FIG. 4 is another view of the umbrella of FIG. 1 showing the hooks of the lower hub engaged with a ledge of the upper fixture.

FIGS. 3 and 4 show an embodiment of the lower hub 516, an upper fixture 532, and a handle 556. The lower hub 516 can be disposed on the outside of the hollow pole assembly 504. The hollow pole assembly 504 can be disposed through an opening in the lower hub 516 that is sized to allow sliding over the outer surface of the pole. The upper fixture 532 can be disposed on the outside of the hollow pole assembly 504 and above the lower hub 516. The handle 556 can be disposed on the outside of the hollow pole assembly 504 and below the lower hub 516. The handle 556 can have an upper portion positioned in a recess 545 of the lower hub 516. When the handle 556 is pulled down, the handle can create a separation between the upper portion of the handle 556 and an internal aspect of the recess 545 of the lower hub 516.

The lower hub 516 can be secured to the hollow pole assembly 504 via the upper fixture 532. The lower hub 516 can include at least one hook 544. Movement of the handle 556 relative to the lower hub 516 of a lower hub assembly 515 of which the handle 556 and the lower hub 516 are a part can actuate the hook 544 or another form of locking mechanism to allow for collapsing the umbrella 500. The upper fixture 532 can include at least one ledge 540. The lower hub 516 can include a plurality of hooks 544. The upper fixture 532 can include a plurality of ledges 540. The number of hooks 544 can correspond to the number of ledges 540. The hook 544 can be pivotally connected to the lower hub 516 via a pin 552. When the umbrella 500 is opened, the hook 544 can rest on the corresponding ledge 540 to help retain the umbrella 500 in an open state. When the umbrella 500 is to be closed, the hook 544 can be disengaged or pivoted away from the ledge 540 to allow the lower hub 516 to move downward along the hollow pole assembly 504 and the umbrella 500. The downward movement of the lower hub 516 allows the umbrella 500 to close. The pulling of the handle 556 can cause the hook 544 to disengage or pivot away from the ledge 540, as discussed further below.

Figure 6:
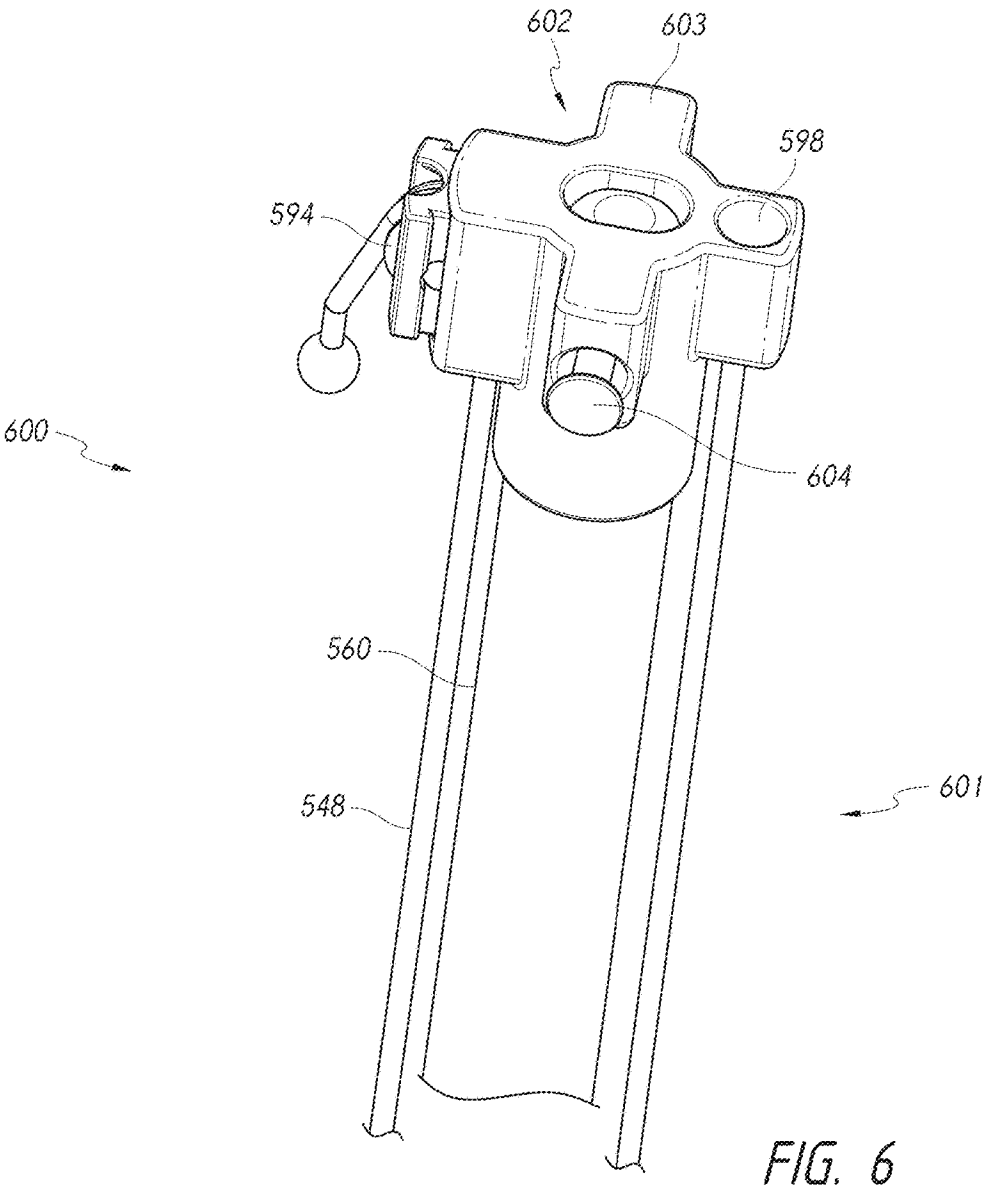
FIG. 6 is a top perspective view of an upper portion of a lift assembly that includes a hollow tube coupled to an inner fixture and a cord disposed over a pulley at one end and coupled to the inner fixture at another end.

FIGS. 3 and 4 also show a cord 548, discussed in more detail below. The cord 548 can assist in the opening and closing of the umbrella 500. A first end 549 of the cord 548 can be coupled with the hollow pole assembly 504 directly or indirectly, e.g., by way of an inner fixture 602. FIG. 3 shows that the inner fixture 602 can be mounted in an inside area of the hollow pole assembly 504. FIG. 6 shows that inner fixture 602 can have a number of protrusions that extend radially outward to free ends that can be in disposed adjacent to or in contact with interior walls of the hollow pole assembly 504. As discussed further below, one of the protrusions of the inner fixture 602 can include an opening 598 for securing the first end 549 of the cord 548. A second end 550 of the cord 548 can be coupled with the lower hub 516, as described in more detail herein. When closing the umbrella 500, the lower hub 516 can be moved downward along the hollow pole assembly 504. As the lower hub 516 moves downward a span or length of the cord 548 can pass over a pulley 594 (e.g., as shown in FIG. 6) coupled with another protrusion of the inner fixture 602. The movement of the span or length of the cord 548 over the pulley 594 can apply a load to compress a gas lifter 601 as discussed in further detail below. The gas lifter 601 is sometimes referred to herein as a gas spring.

Figure 5A:
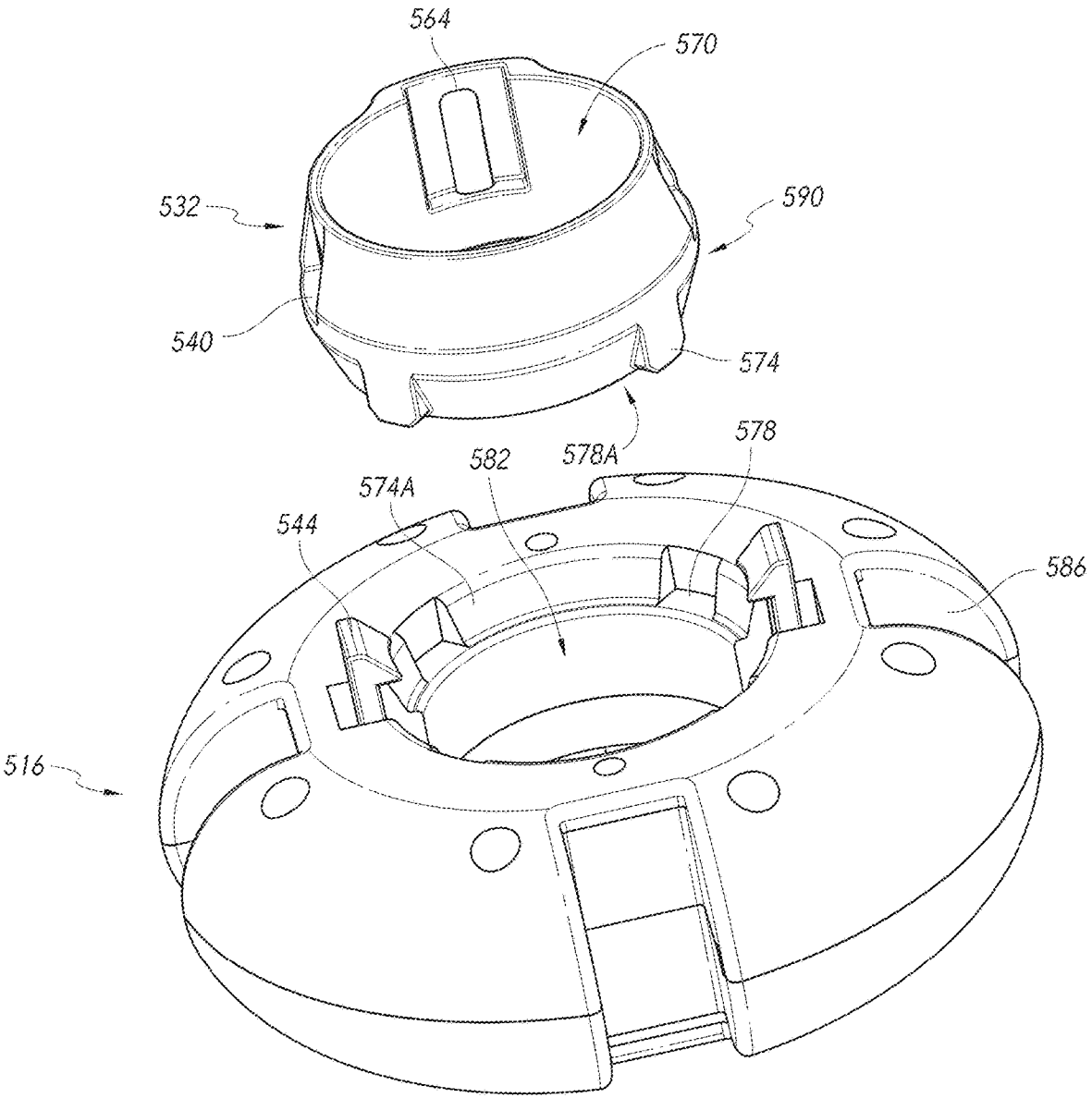
FIG. 5A is an exploded view of the lower hub and upper fixture of the portion of the umbrella of FIG. 1 shown in FIG. 3.

FIG. 5A shows an exploded view of the lower hub 516 and the upper fixture 532. The upper fixture 532 can be sized to fit at least partially within the lower hub 516. The outer perimeter 590 of the upper fixture 532 can be sized to fit within the opening 582 of the lower hub 516. In some embodiments, the upper fixture 532 can have at least one radial projection 574. Any number of radial projections 574 can be used. For example, one, two, three, four or more radial projections 574 can be provided. The lower hub 516 can have at least one radial recess 578. The number of radial recesses 578 can correspond to the number of radial projections 574. The radial projections 574 can be positioned and/or aligned with the radial recesses 578 when positioning the upper fixture 532 within the opening 582 of the lower hub 516. The radial projection(s) 574 can be sized to fit within the radial recess(es) 578. The circumferential extent of the radial projection(s) 574 can be less than the circumferential extent of the radial recess(es) 578. The upper fixture 532 can remain fixed in its position on the hollow pole assembly 504 while the lower hub 516 moves along the hollow pole assembly 504 to open and close the umbrella 500. Also, the upper fixture 532 can have one or a plurality of radial recesses 578A and the lower hub 516 can have one or a plurality of radial projection 574A. The radial projection(s) 574A can be received within the radial recess(es) 578A. The radial projection(s) 574 and radial recess(es) 578 and/or the radial projection(s) 574A and the radial recess(es) 578A to reduce, restrict or eliminate rotational movement of the lower hub 516 relative to the hollow pole assembly 504.

The upper fixture 532 can include at least one ledge 540, as discussed herein. The upper fixture 532 can have one, two, three or more ledges 540. The at least one ledge 540 can interact with the at least one hook 544 of the lower hub 516, as described herein. There can be a corresponding number of ledges 540 and hooks 544. The ledge 540 can be disposed on opposite sides of the upper fixture 532, e.g., can be disposed on a common diameter of the upper fixture 532.

The upper fixture 532 can have a slot 564. The slot 564 can allow the cord 548 to exit the interior space of the hollow pole assembly 504 to be coupled to the lower hub 516 as described herein. The slot 564 can be sized to allow a portion of the pulley 594 to extend at least partially into and through a wall of the upper fixture 532. In one embodiment an assembly including the pulley 594 can be partially or completely mounted to the upper fixture 532.

The lower hub 516 can have at least one strut recess 586. The struts (e.g., struts 520) can be coupled to the lower hub 516 by being positioned within the corresponding strut recesses 586. Pins or other pivot members (not shown) can be used to secure the struts 520 in place. The number of struts 520 can be equal to the number of strut recesses 586 in various embodiments of the umbrella 500.

Figure 5B:
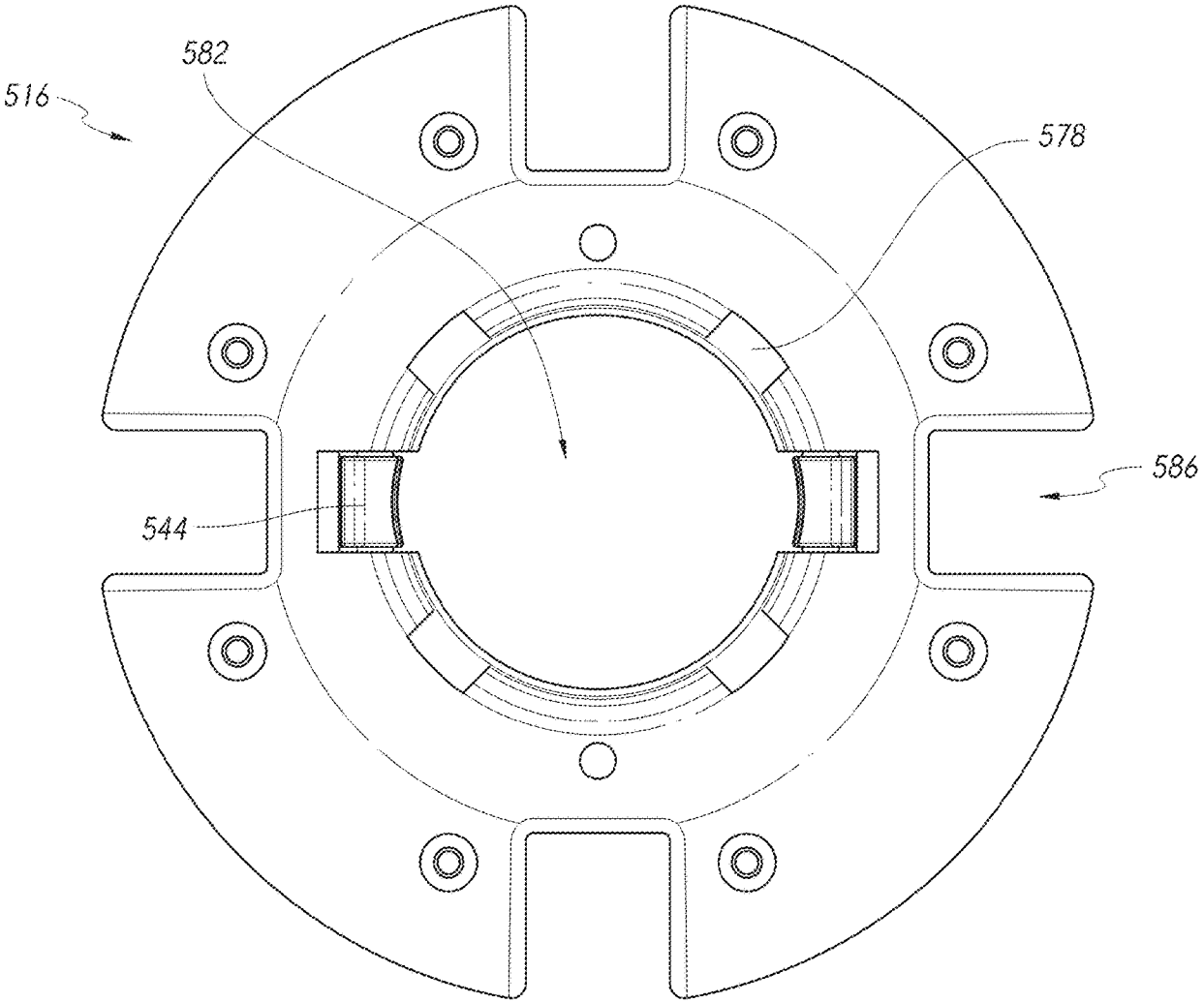
FIG. 5B is a top view of the lower hub of the umbrella of FIG. 1, the lower hub including alignment recesses.

FIG. 5B shows a top view of the lower hub 516. As described above, the lower hub 516 can include hooks 544. In some embodiments, the lower hub 516 can have two hooks 544. The hooks 544 can be positioned opposite each other, e.g., symmetrically about a common diameter extending across the lower hub 516. In some embodiments, the hooks 544 (e.g., two, three, four, or more hooks 544) can be spaced equally around the opening 582 of the lower hub 516. In some embodiments, the hooks 544 can be spaced at unequal distances around the opening 582. The lower hub 516 can have radial recesses 578 for maintaining alignment with the upper fixture 532 as described in more detail above. The lower hub can have strut recesses 586 as described in more detail above.

Figure 5C:
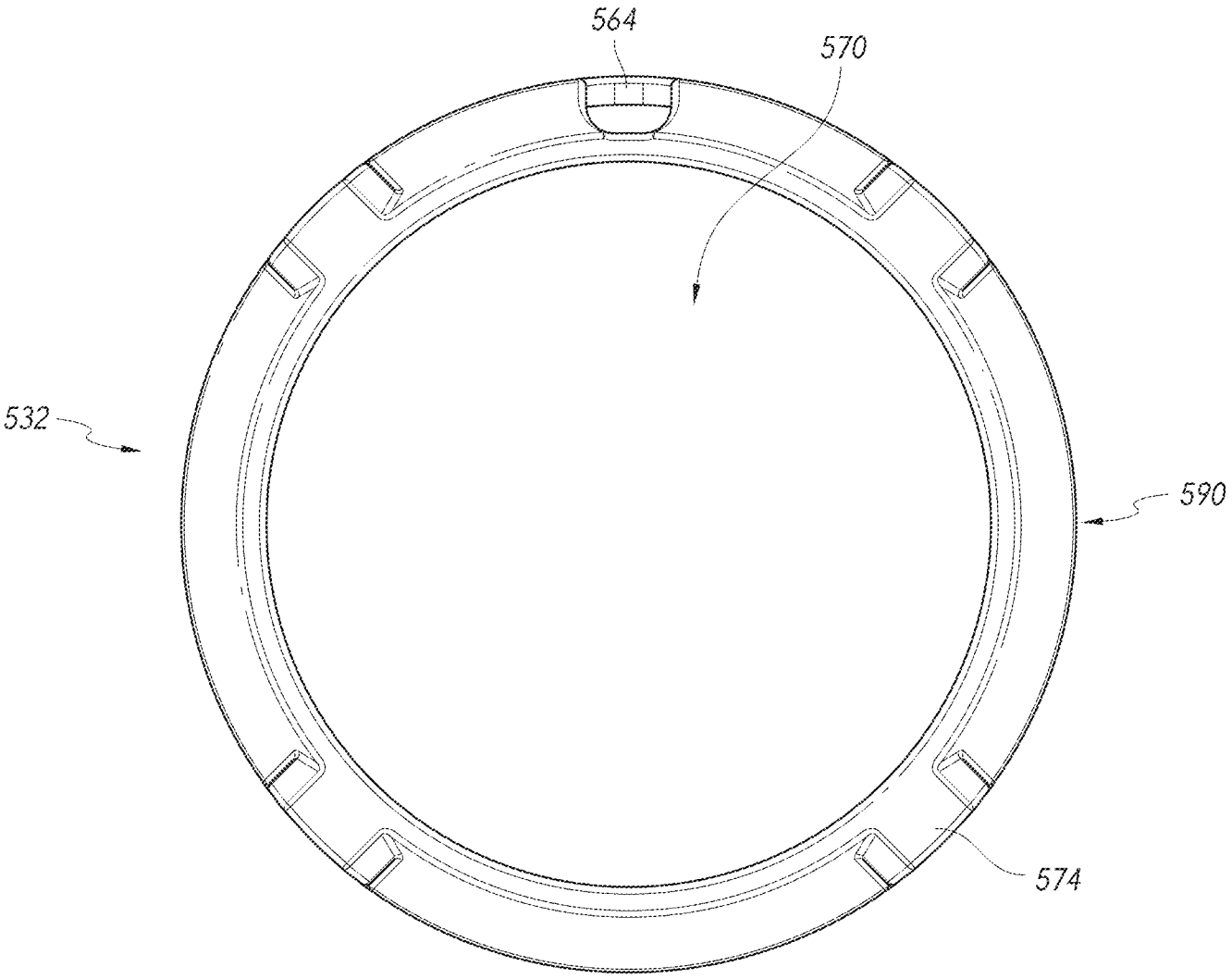
FIG. 5C is a bottom view of the upper fixture of the umbrella of FIG. 1, the upper fixture including alignment tabs.

FIG. 5C shows a bottom view of the upper fixture 532. As described above, the upper fixture 532 can include radial projections 574. The radial projections 574 can protrude outward from a bottom surface of the upper fixture 532. The radial projection 574 can extend between a smaller diameter of the bottom surface and an outer perimeter 590 of the upper fixture 532. In some cases, the outer perimeter 590 has a larger diameter than the outer diameter of the bottom surface of the upper fixture 532. The radial projections 574 can be configured to interact with the radial recesses 578 as described above. The upper fixture 532 can have a slot 564. The slot 564 can allow the cord 548 to exit the interior space of the hollow pole assembly 504 to be coupled to the lower hub 516 as described herein. With reference, to FIG. 6, the cord 548 can be disposed over pulley 594. The cord 548 can then exit through the slot 564 to couple to the lower hub 516.

Figure 5D:
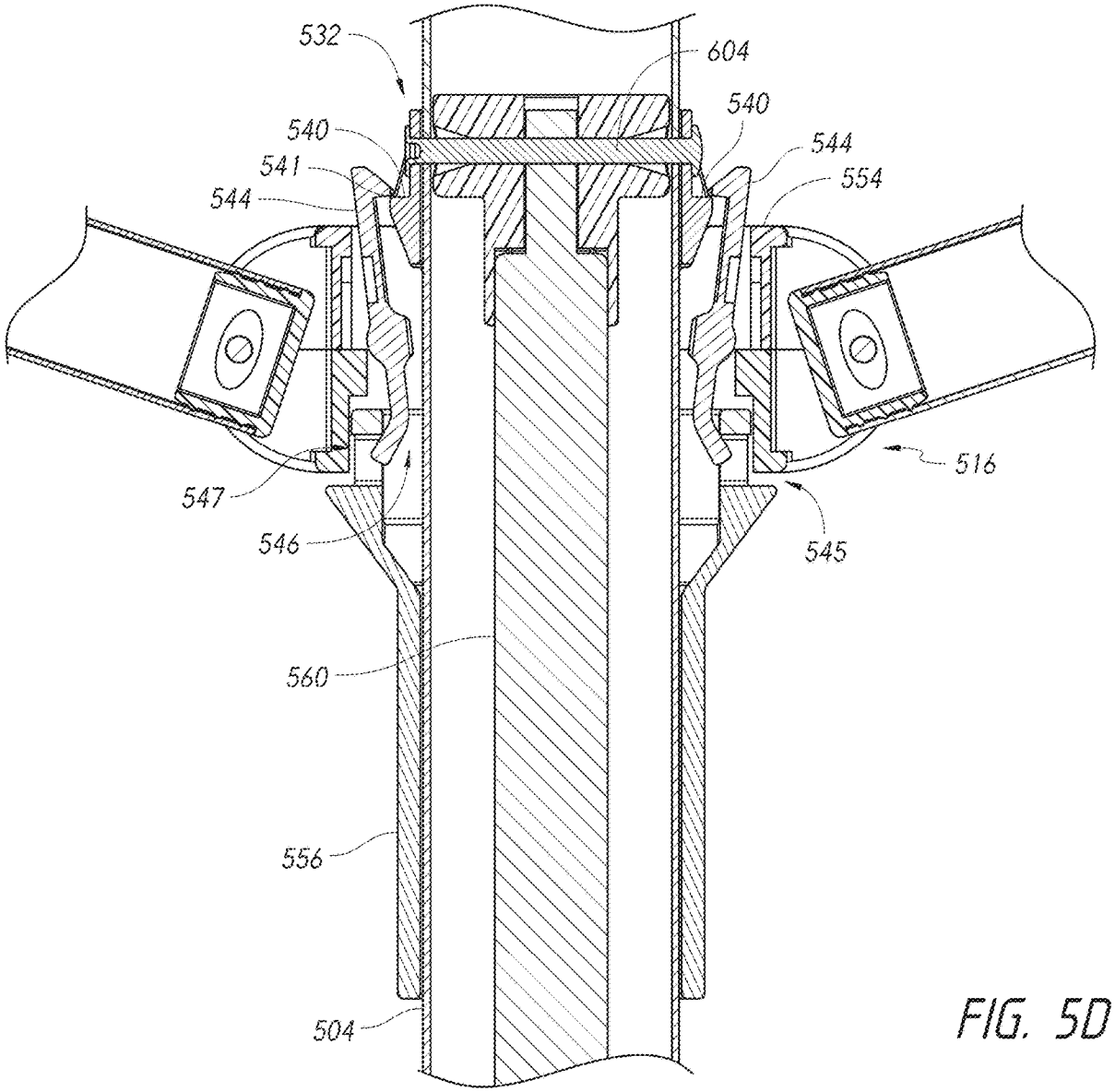
FIG. 5D shows a cross-section of the lower hub and handle, with the handle in a second position to disengage hooks from ledges of the upper fixture.

FIG. 5D shows a cross-section of the lower hub 516 and the handle 556. The handle 556 is in a position to disengage the hooks 544 from the ledges 540 of the upper fixture 532. The handle 556 can be pulled down along the hollow pole assembly 504. When the handle 556 is pulled down, the handle can create a separation between the upper portion of the handle 556 and an internal or lower aspect of the recess 545 of the lower hub 516. The movement of the handle 556 can disengage a prong 541 of the hooks 544 from the ledges 540. The hooks 544 can pivot away from the corresponding ledges 540 allowing the lower hub 516 to move downward along the hollow pole assembly 504. The hooks 544 can have a curved lower portion 546 that can be moved inward toward the hollow pole assembly 504 within a gap or space 547 when the handle 556 is pulled down. The curved lower portion 546 can move radially inward within the gap or space 547 to allow the hook 544 to pivot away from the corresponding ledge 540, which in turn can allow the lower hub 516 to move downward along the hollow pole assembly 504. An upper structure of the handle 556, such as a roller or projections, can rest on or just above the curved portion of the hook 544 such that as the handle 556 moves down the upper structure applies a load to the curved portion. When closing the umbrella 500, the upper portion of the hook 544 can move further away from the hollow pole assembly 504, while the curved lower portion 546 can move closer to the hollow pole assembly 504 by radially inward load applied by the roller or projection of the upper structure. The distance the upper portion of the hook 544 can move away from the hollow pole assembly 504 can be limited by an interior wall 554 of the lower hub 516. The limited movement can allow for a more controlled locking and unlocking process.

Figure 8:
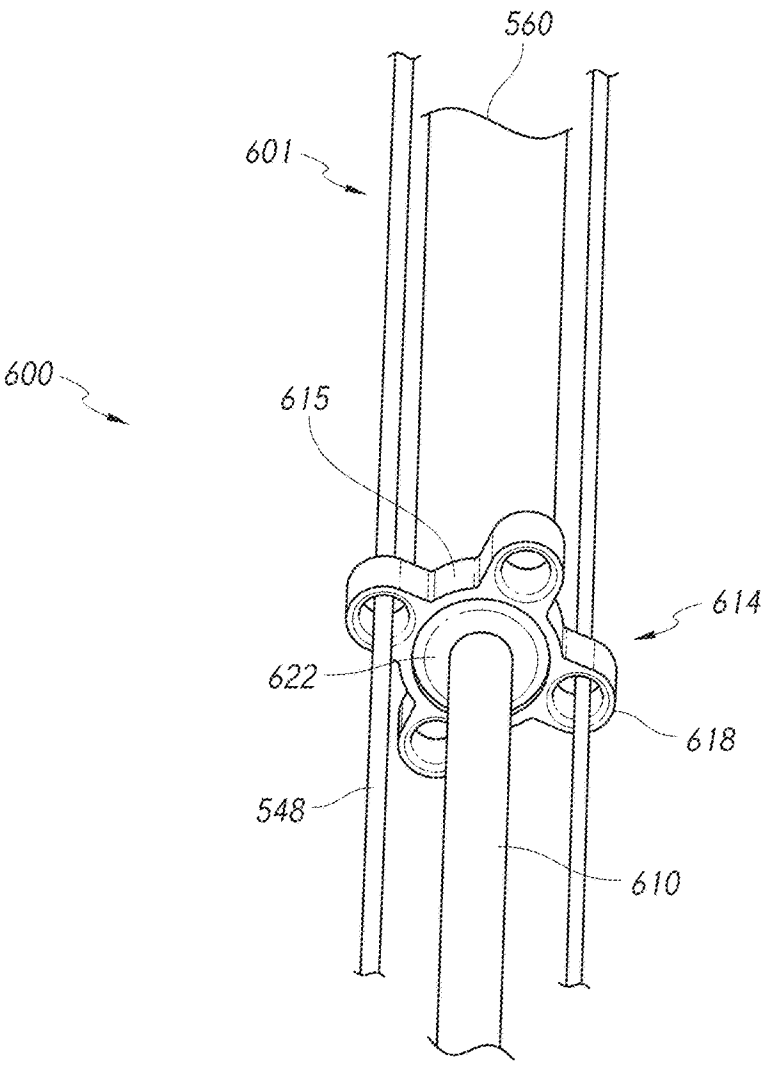
FIG. 8 is a bottom perspective view of the lift assembly of FIGS. 6 and 7 showing the piston extending to within the hollow tube and a seal disposed between the piston and the hollow tube.
Figure 7:
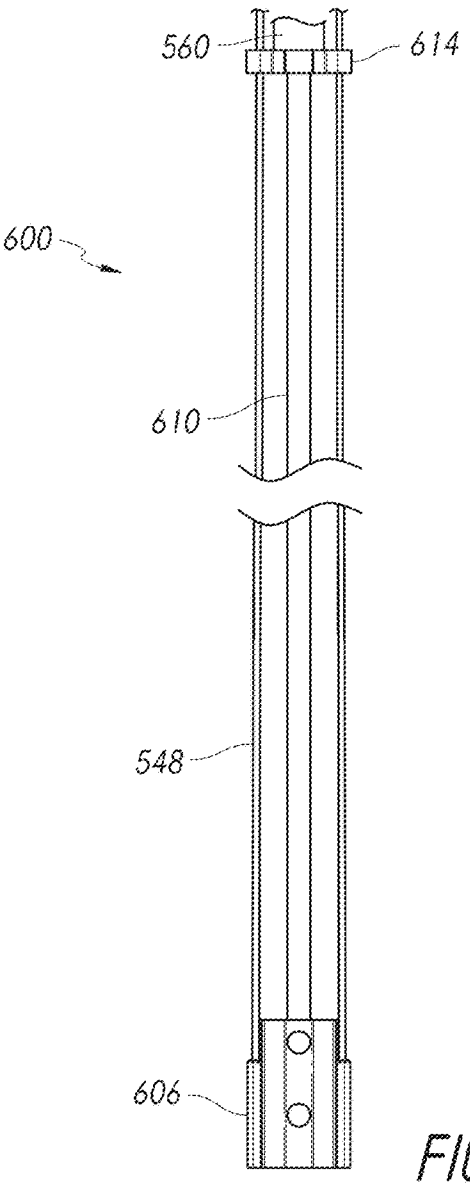
FIG. 7 is a side view of a lower portion of the lift assembly of FIG. 6 showing a piston coupled to the hollow tube at one end and coupled to a lower fixture at another end.

FIGS. 6-8 show a lift assembly 600. The lift assembly 600 can be disposed within the hollow pole assembly 504. The lift assembly 600 can include a gas lifter 601. The gas lifter 601 is sometimes referred to herein as a gas spring. As discussed further below, the gas lifter 601 is a device that stores potential energy in a compressed gas and then releases that energy to apply a load as needed. In some embodiments, the gas lifter 601 can include the hollow tube 560 having an open interior. The gas lifter 601 can include a piston 610. The outer diameter of the piston 610 can be sized to fit within the inner diameter of the hollow tube 560. The gas lifter 601 can include a seal 622. The seal 622 can be positioned between the inner diameter of the hollow tube 560 and outer diameter of the piston 610, as shown in FIG. 8.

As shown in FIG. 6, the hollow tube 560 can be coupled to inner fixture 602. The inner fixture 602 can be coupled to the hollow pole assembly 504. In some embodiments, the inner fixture 602 can be coupled to the upper fixture 532. The inner fixture 602 can have protrusions 603. Two or more of the protrusions 603 can be coupled to the hollow pole assembly 504 or the upper fixture 532. The inner fixture 602 can have two, three, four or more protrusions 603 to fix the inner fixture 602 with the hollow pole assembly 504. The protrusions 603 can have an extender 604. The extender 604 can have a narrower diameter or cross-section than the protrusion 603. The extender 604 can assist in coupling the inner fixture 602 to the hollow pole assembly 504 or the upper fixture 532. The extender 604 can include a rivet, a screw or a bolt to secure the upper fixture 532 to the hollow pole assembly 504. FIG. 5D shows that the hollow tube 560 can be fixed to the hollow pole assembly 504 by the inner fixture 602 and the extender 604. The movement of the gas lifter 601 is by way of the piston 610 from below the position of the upper portion of the hollow tube 560 which is secured to the hollow pole assembly 504 by the extender 604. The lower end of the piston 610 moves downward as stored energy is released, as discussed further below. This allows the piston 610 to move over a distance that can be any distanced from the location of the lower end of the hollow tube 560 to the lower end of the hollow pole assembly 504. Also, the free end of the piston 610 is not directly connected to a hub. Thus, the movement of the free end is not limited by an amount of movement of a hub, but rather can be adjusted as needed. In examples disclosed herein, this allows the umbrella 500 to be designed with just two hubs, e.g., the upper hub 512 and the lower hub 516. Also, the free end of the piston 610 of the gas lifter 601 can be disposed outside of the expanse of the umbrella 500 that is between the upper hub 512 and the lower hub 516, e.g., below the lower hub 516. By providing for umbrella assist operation using the gas lifter 601 without locating the free end of the piston 610 between or within the hubs, the umbrella 500 can be constructed without any intermediate struts coupled with intermediate hubs. This approach simplifies the design by eliminating unnecessary pivotable connections between shorter struts.

The cord 548 can be positioned over the pulley 594 and extend down the length of the hollow tube 560. The cord 548 can extend through an opening of a first projection 618 of a cord guide member 614. The cord guide member 614 can be disposed around the hollow tube 560. The projections 618 of the cord guide member 614 can be positioned around the cord guide member 614 separated at equal or unequal distances. The cord guide member 614 can have at least two projections 618. The cord 548 can continue to extend down along the length of piston 610, as shown in FIGS. 7 and 8. The cord 548 can extend into and out a lower fixture 606, as discussed in more detail below. The cord 548 can then extend back up the length of piston 610, through a second opening of a second projection 618 of the cord guide member 614, up the length of the hollow tube 560 and be coupled at an opening 598 of the inner fixture 602.

The member 614 serves a spacing function the umbrella 500 in some examples. The member 614 comprise a centering member such that it is disposed centrally in the interior space of the hollow pole assembly 504. The projections 618 can extend substantially equal amounts from a central hub 615 of the member 614. The projection 618 can have an arcuate outer periphery to contact an inner diameter of the hollow pole assembly 504. In one embodiment, an outer surface of the projection 618 has a radius that is smaller than the radius of the hollow pole assembly 504 such that the contact between the member 614 and the inner surface of the hollow pole assembly 504 can be tangential or along a short arc of the inner surface of the hollow pole assembly 504. The member 614 is coupled with a bottom end of the hollow tube 560 and can be used to position the hollow tube 560 generally centrally within the hollow pole assembly 504, e.g., by placing each of two, three, four, or more projection 618 in contact with the inner surface of the hollow pole assembly 504. As discussed above, the cord guide member 614 may also have one or more openings to allow the cord 548 to pass through. In other embodiments, the cord 548 is allowed to pass between the member 614 (serving to center the hollow tube 560) and the inner surface of the hollow pole assembly 504 but not through any portion of the member 614.

When closing the umbrella 500, the cord 548 can apply a load to compress the gas lifter 601. In some embodiments, the piston 610 can be moved at least partially into or deeper into the hollow tube 560 to compress air or another gas within the hollow tube 560. When opening the umbrella 500, the gas lifter 601 can apply a load to the cord 548 to cause the lower hub 516 to be moved upward and open the umbrella 500.

When the umbrella 500 is open, the length of the cord 548 between the first end 549 and the lower fixture 606 and the length of the cord 548 between the second end 550 and the lower fixture 606 can be similar, e.g., substantially equal. When the umbrella 500 is closed, the length of the cord 548 between the first end 549 and the lower fixture 606 can be greater than the length of the cord 548 between the first end 549 and the lower fixture 606 when the umbrella is opened. When the umbrella 500 is closed, the length of the cord 548 between the second end 550 and the lower fixture 606 can be greater than the length of the cord 548 between the second end 550 and the lower fixture 606 when the umbrella is opened. When the umbrella 500 is closed, the length of the cord 548 between the first end 549 and the lower fixture 606 can be greater than the length of the cord 548 between the second end 550 and the lower fixture 606. The length of the cord 548 between the first end 549 and the lower fixture 606 can increase as the lower hub 516 is moved downward along the hollow pole assembly 504. The length of the cord 548 between the first end 549 and the lower fixture 606 can decrease as the lower hub 516 is moved upward along the hollow pole assembly 504. The length of the cord 548 between the second end 550 and the lower fixture 606 can increase as the lower hub 516 is moved downward along the hollow pole assembly 504. The length of the cord 548 between the second end 550 and the lower fixture 606 can decrease as the lower hub 516 is moved upward along the hollow pole assembly 504.

Figure 9:
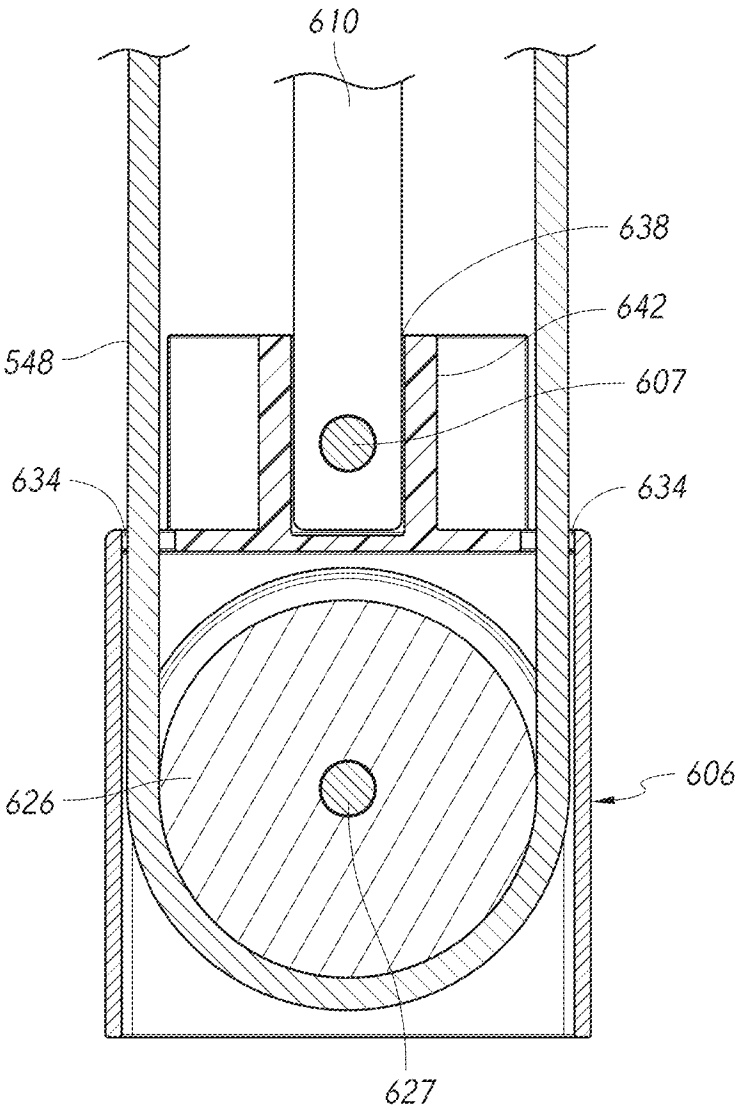
FIG. 9 is a cross-section view of the lower fixture of the lower portion of the lift assembly shown in FIG. 7, the lower fixture supporting a pulley, the cord positioned over the lower side of pulley.

FIG. 9 shows a cross section view of an example of the lower fixture 606. The lower fixture 606 can be coupled to the piston 610. The piston 610 can be sized to fit within an opening 638 of a core member or central hub 642 in the lower fixture 606. In some embodiments, the piston 610 can be coupled to lower fixture 606 by a pin, a rivet, a screw, a bolt, or other shaft member 607. Any suitable means can be used to couple the piston 610 to the lower fixture 606. The cord 548 can extend within the lower fixture 606 and be disposed around a pulley 626. The pulley 626 can be supported on the core member 642 by an axle 627. The axle 627 can comprise a smooth, round central portion of a rivet, screw, bolt or other member mounted across the lower fixture 606. The cord 548 can enter a first cord opening 634 of the lower fixture 606. The cord can then extend around the pulley 626 and exit a second cord opening 634 of the lower fixture 606. A span of the cord 548 over the pulley 626 can be disposed above a lower end of the lower fixture 606 to protect the cord 548 from contact as it moves over the pulley 626.

Figure 10:
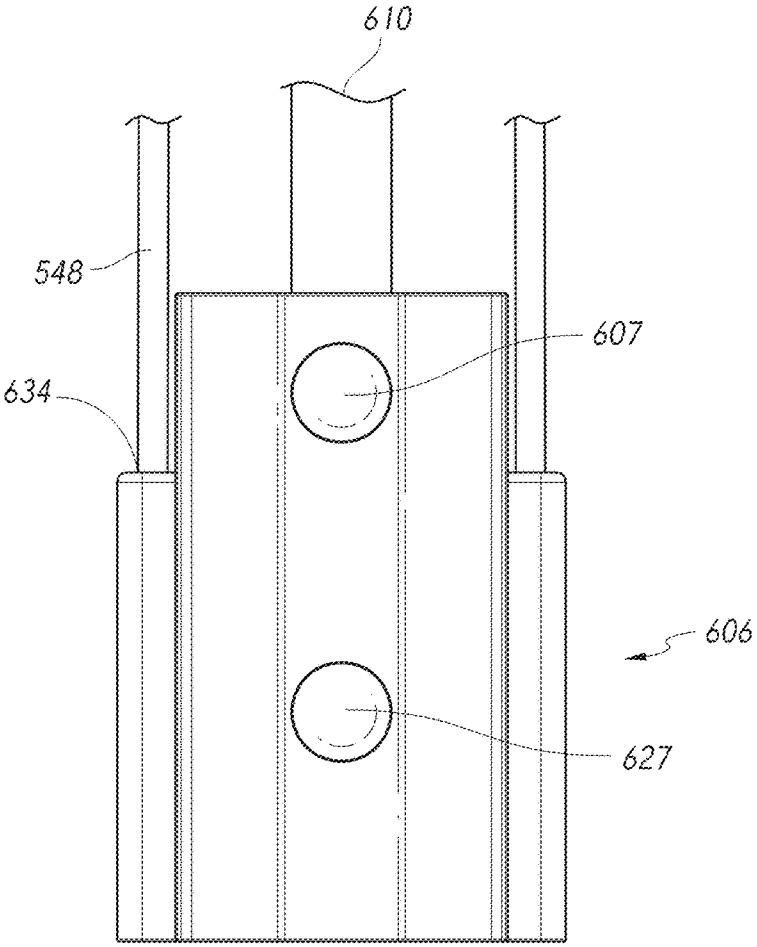
FIG. 10 shows the lower fixture of FIG. 9 with the piston coupled thereto and the cord positioned within cord openings thereof.

FIG. 10 shows another view of the lower fixture 606. As shown and described herein, the lower fixture 606 can include cord openings 634 for the cord 548 to enter through before being disposed over a pulley 626. The lower fixture 606 can be coupled to the piston 610 as described herein.

Figure 11:
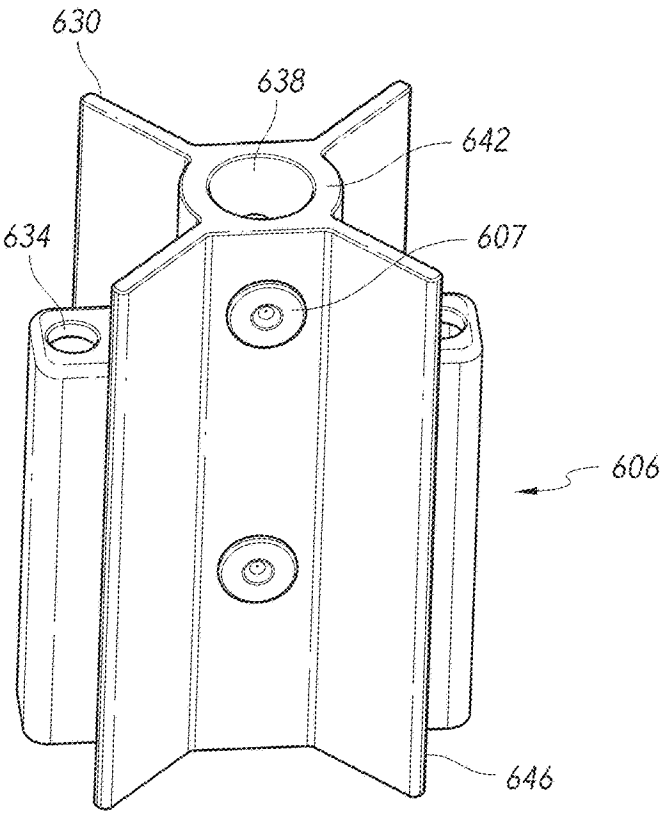
FIG. 11 shows the lower fixture of FIG. 10 with the lower end of the piston and the cord removed, better illustrating a piston opening, the cord openings, and spacers.

FIG. 11 shows an example embodiment of the lower fixture 606 having spacers 630 and cord openings 634. Any number of spacers 630 can be used. For example, one, two, three, four or more spacers 630. The spacers 630 can extend the entire length of the lower fixture 606. In some embodiments, the spacers 630 can extend a portion of the length of the lower fixture 606. The spacers 630 can be spaced equally around the opening 638 and the core member 642. In some embodiments, the spacers 630 can be spaced at unequal distances around the opening 638. The spacers 630 can extend outward from the core member 642. The spacers 630 can have outer edges 646. The spacers 630 can have a plate-like configuration, e.g., being elongate in a vertical direction and having rectangular side surfaces with relatively thin circumferential thickness. The outer edges 646 of the spacers 630 can assist in maintaining the alignment of the lift assembly 600 when moving within the hollow pole assembly 504 by engaging the inner wall of the hollow pole assembly 504. The thin contact between the spacers 630 and the inner walls of the hollow pole assembly 504 provide for minimal sliding friction.

The cord openings 634 can be sized to allow the cord 548 to fit within the cord openings 634. The cord openings 634 can be positioned on opposite sides of the lower fixture 606. In some embodiments, each cord opening 634 can be positioned between two spacers 630. The cord openings can extend down at least a portion of the length of the lower fixture 606. As described herein, the cord 548 can enter a first cord opening 634 and then be disposed around a pulley 626 and then exit a second cord opening 634.

Figure 12:
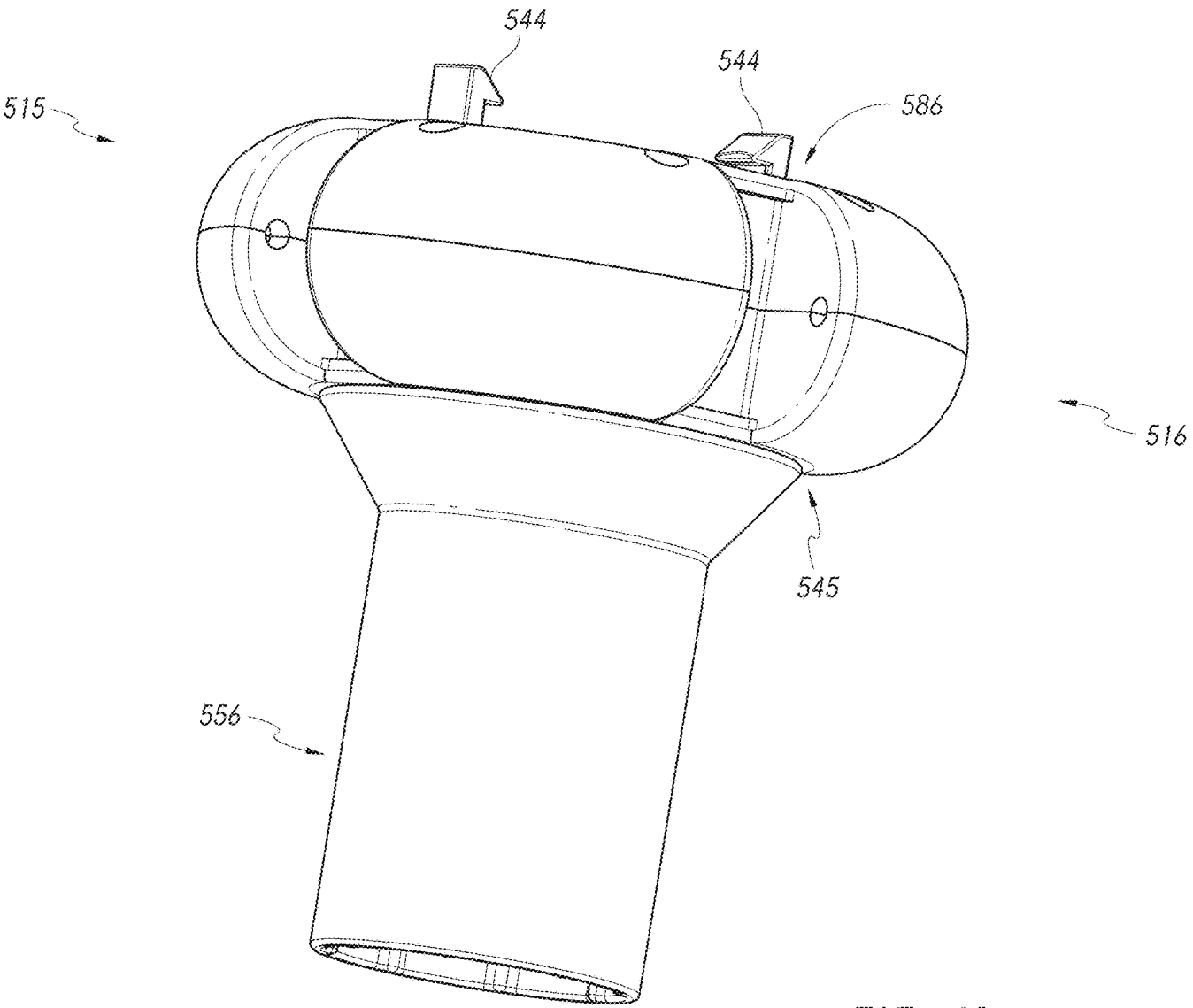
FIG. 12 shows a perspective view of a design of an umbrella hub and a handle.

FIGS. 12-17 show a design of an umbrella hub 515. FIG. 12 shows a perspective view of a design of an umbrella hub 515 with a lower hub 516, a handle 556, and hooks 544. The lower hub 516 can be located above the handle 556. An upper portion of the handle 556 can be positioned in a recess 545 of the lower hub 516. The hooks 544 can extend above the upper surface of the lower hub 516. The lower hub 516 can include strut recesses 586.

Figure 14:
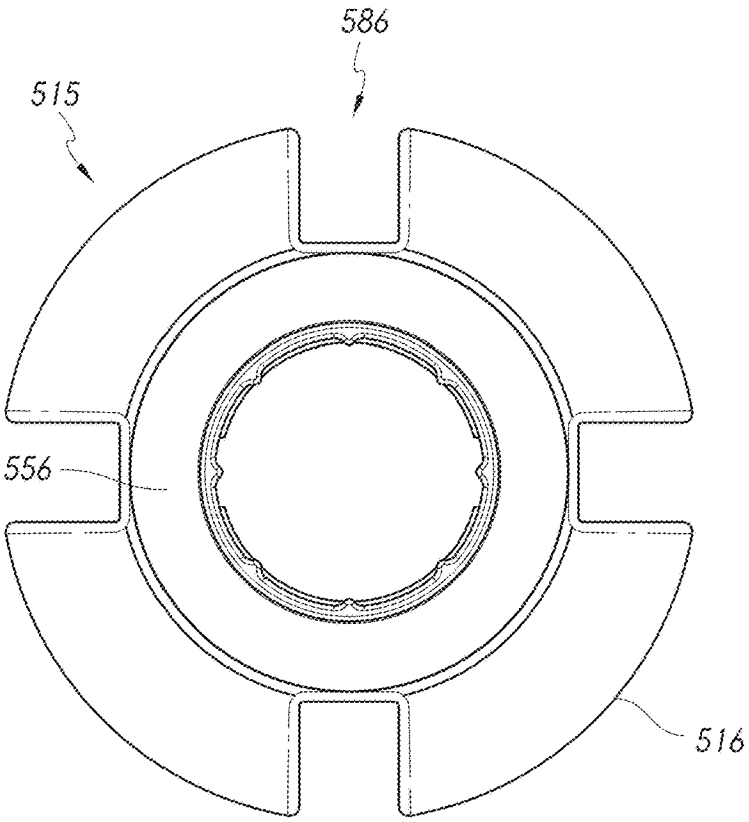
FIG. 14 shows a bottom view of the umbrella hub and handle design of FIG. 12.
Figure 13:
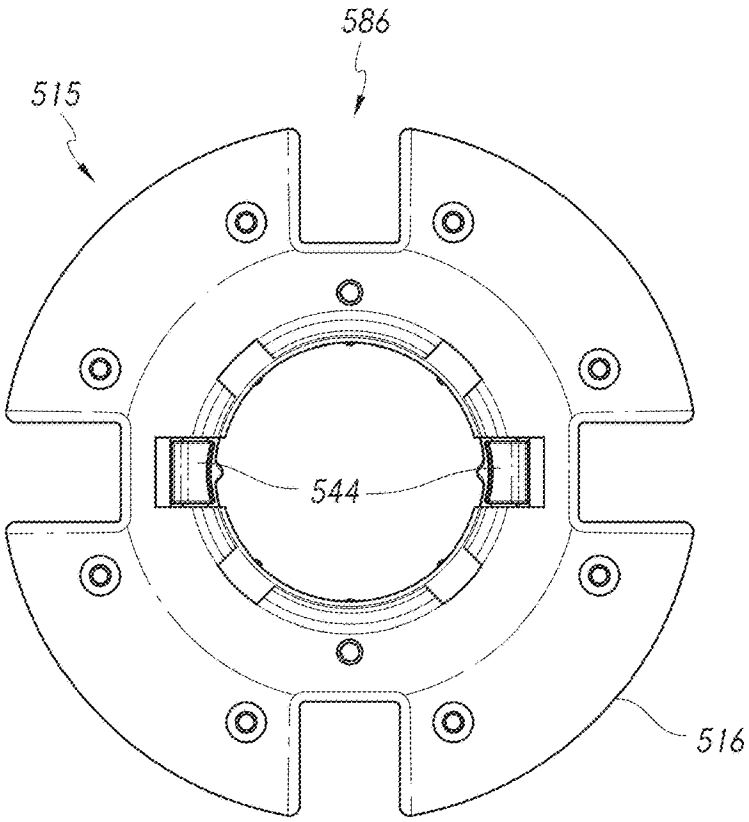
FIG. 13 shows a top view of the umbrella hub and handle design of FIG. 12.

FIG. 13 shows a top view of the umbrella hub 515. The lower hub 516 is shown as having four strut recesses 586. The strut recesses 586 can be evenly spaced around the circumference of the lower hub 516. The hooks 544 can be positioned across from each other within an inner diameter of the lower hub 516. FIG. 14 shows a bottom view of the umbrella hub 515. As shown, the upper portion of the handle 556 can taper inward towards the base of the handle 556.

Figure 16:
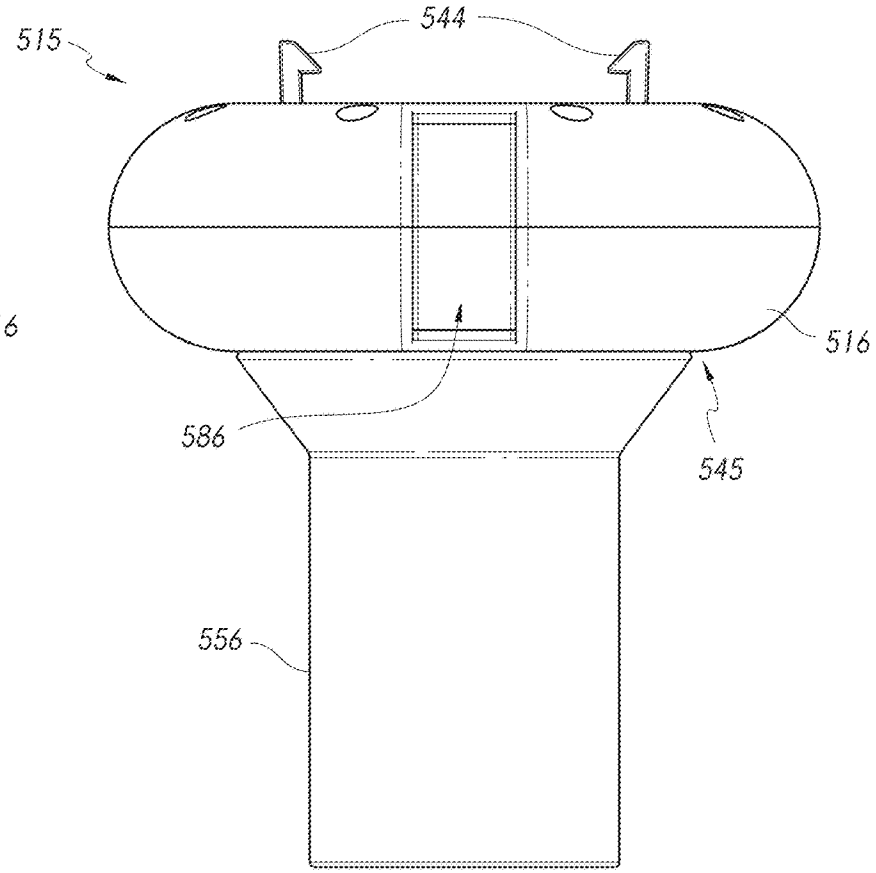
FIGS. 15-16 show side views of the umbrella hub and handle design of FIG. 12 with the handle in a first position.
Figure 15:
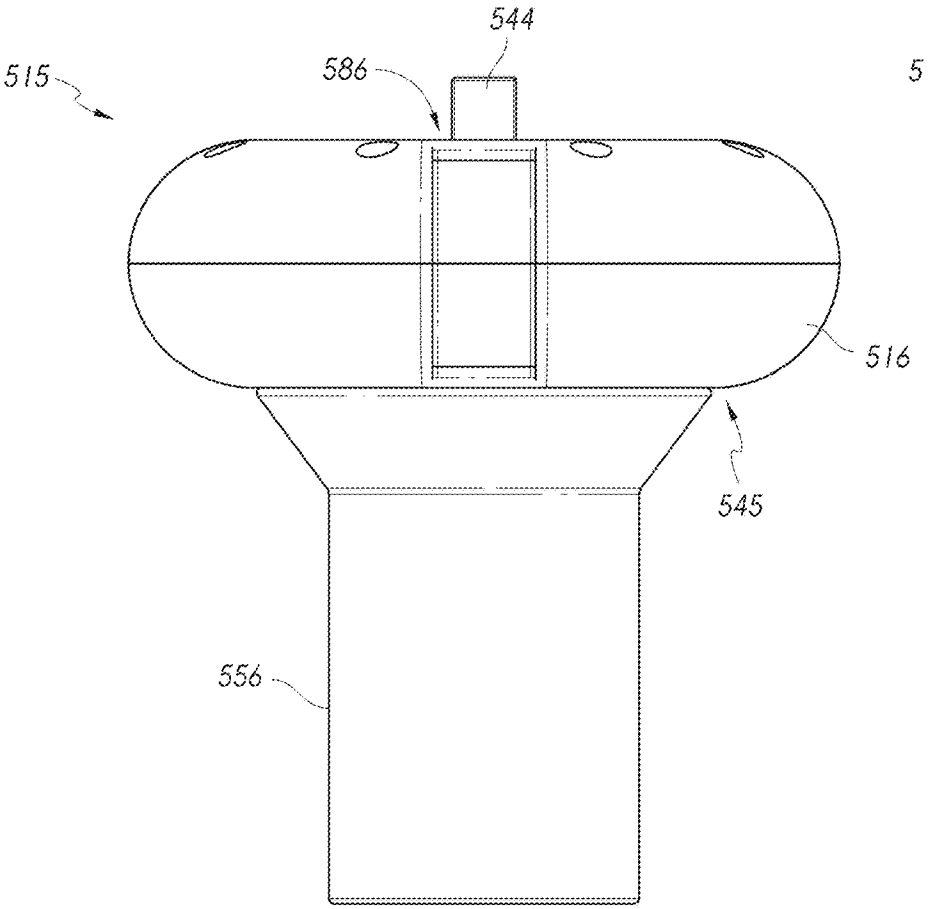

FIGS. 15-16 show side views of the umbrella hub 515 in a first configuration. As described herein, the handle 556 is positioned within the recess 545 of the lower hub 516. The hooks 544 can align with two of the strut recesses 586. FIG. 16 shows that the hooks 544 can be substantially parallel to a longitudinal access extending through the center of the umbrella hub 515.

Figure 17:
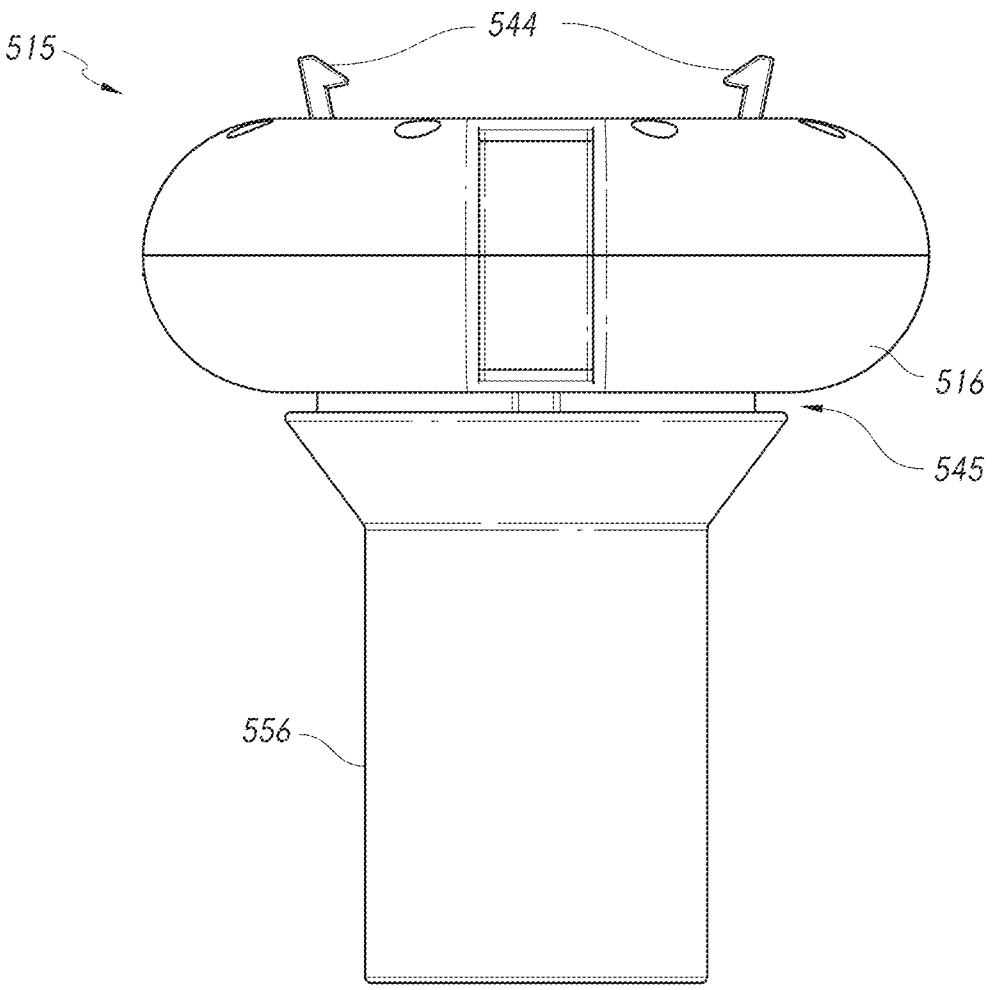
FIG. 17 shows a side view of the umbrella hub and handle design of FIG. 12 with the handle in a second position.

FIG. 17 shows a side view of the umbrella hub 515 in a second configuration. The handle 556 is positioned downward compared to the position in FIG. 16 and partially out of the recess 545 of the lower hub 516. The hooks 544 have pivoted away from the longitudinal access extending through the center of the umbrella hub 515.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. An umbrella comprising:

a hollow pole;

a shade assembly coupled with an upper portion of the hollow pole, the shade assembly comprising:

an upper hub, a lower hub, a shade structure coupling the upper hub to the lower hub, the shade structure supporting a shade member, wherein the lower hub is moveable along the hollow pole;

an upper fixture disposed on the hollow pole, the upper fixture comprising a pulley and at least one ledge configured to interact with at least one hook pivotally coupled to the lower hub; and a lift assist assembly disposed within the hollow pole, the lift assist assembly comprising:

a gas spring comprising:

a hollow tube having an inner diameter;

a piston having an outer diameter sized to fit within at least a portion of the hollow tube;

a seal positioned between the inner diameter of the hollow tube and the outer diameter of the piston; and a lower fixture coupled to a lower end of the piston, the lower fixture comprising at least two spacers; and a cord having a first end disposed within the hollow pole and a second end coupled with the lower hub, the first end disposed at a fixed position in an upper region of the hollow pole;

wherein when closing the umbrella, the at least one hook disengages from the at least one ledge and the lower hub is moved downward and the cord applies a load to compress the gas spring by moving the piston into the hollow tube, and wherein when opening the umbrella the gas spring applies a load to the cord, to cause an upward load to be applied to the lower hub.

2. An umbrella comprising:

a hollow pole;

a shade assembly coupled with an upper portion of the hollow pole, the shade assembly comprising:

an upper hub, a lower hub, a shade structure coupling the upper hub to the lower hub, the shade structure supporting a shade member, wherein the lower hub is moveable along the hollow pole;

an upper fixture disposed on the hollow pole, the upper fixture comprising a pulley and at least one ledge configured to interact with at least one hook pivotally coupled to the lower hub;

a lift assist assembly disposed within the hollow pole, the lift assist assembly comprising:

a gas spring comprising:

a hollow tube having an inner diameter;

a piston having an outer diameter sized to fit within at least a portion of the hollow tube;

a seal positioned between the inner diameter of the hollow tube and the outer diameter of the piston; and a lower fixture coupled to a lower end of the piston, the lower fixture comprising at least two spacers, wherein the lower fixture comprises a core member and four spacers extending outward from the core member to outer edges, the outer edges of the spacers configured to engage an inner wall of the hollow pole; and a cord having a first end disposed within the hollow pole and a second end coupled with the lower hub, wherein when closing the umbrella, the at least one hook disengages from the at least one ledge and the lower hub is moved downward and the cord applies a load to compress the gas spring by moving the piston into the hollow tube, and wherein when opening the umbrella the gas spring applies a load to the cord, to cause an upward load to be applied to the lower hub.

3. The umbrella of claim 1, wherein the lower fixture comprises a pulley supported on a core member, the cord is disposed around the pulley.

4. An umbrella comprising:
a hollow pole;
a shade assembly coupled with an upper portion of the hollow pole, the shade assembly comprising:
an upper hub, a lower hub, a shade structure coupling the upper hub to the lower hub, the shade structure supporting a shade member, wherein the lower hub is moveable along the hollow pole;
a lift assist assembly disposed within the hollow pole, the lift assist assembly comprising:
a gas spring comprising a hollow tube having an open interior; and
a piston disposed within the open interior of the hollow tube; and
a cord having a first end disposed within the hollow pole and a second end coupled with the lower hub, the first end disposed at a fixed position, the first end and the second end connected by a length of the cord, at least a portion of the length of the cord extending from the fixed position toward a lower region of the hollow pole and from the lower region of the hollow pole upward toward the lower hub, wherein when closing the umbrella, the cord moves the piston into the hollow tube compressing a gas within the hollow tube and when opening the umbrella the gas spring applies a load to the cord, to cause the lower hub to be moved upward.

5. The umbrella of claim 4, further comprising a hook pivotably mounted in the lower hub, the hook configured to rest on a ledge of the hollow pole when the umbrella is open and to pivot away from the ledge to allow the umbrella to be closed, the pivoting of the hook being actuated by downward movement of a lower portion of a hub assembly including the lower hub relative to the lower hub.

6. The umbrella of claim 5, wherein the lower portion of the hub assembly further comprises a handle extending downward relative to an upper portion of the lower hub, the handle being moveable downward when the hook is resting on the ledge to pivot the hook away from the ledge to allow the lower hub to be lowered to allow the umbrella to be closed.

7. The umbrella of claim 4, wherein the cord is disposed over a pulley coupled with the hollow pole and is tension by downward movement of the piston of the gas spring.

8. The umbrella of claim 4, further comprising a lower fixture coupled to a lower end of the piston, the lower fixture comprising at least two spacers.

9. The umbrella of claim 8, wherein the lower fixture further comprises a pulley and the cord is disposed around the pulley.

10. An umbrella comprising:
a hollow pole;
a shade assembly coupled with an upper portion of the hollow pole, the shade assembly comprising:
an upper hub, a lower hub, a shade structure coupling the upper hub to the lower hub, the shade structure supporting a shade member, wherein the lower hub is moveable along the hollow pole; and
a lift assist assembly disposed within the hollow pole, the lift assist assembly comprising a gas spring and a cord having a first end disposed within the hollow pole and a second end coupled with the lower hub, the first end disposed at a fixed position, the cord having a length between the first end and the second end, the length of the cord disposed around a first pulley positioned below a lower end of the lift assist assembly, wherein when closing the umbrella, the cord applies a load to compress the gas spring, and wherein when opening the umbrella the gas spring applies a load to the lower hub by way of the cord.

11. The umbrella of claim 10 further comprising a hook pivotably mounted in the lower hub, the hook configured to rest on a ledge of the hollow pole when the umbrella is open and to pivot away from the ledge to allow the umbrella to be closed, the pivoting of the hook being actuated by downward movement of a handle relative to an upper portion of the lower hub.

12. The umbrella of claim 11, wherein the handle extends downward from a lower portion of the lower hub, the handle being moveable downward relative to an upper portion of the lower hub when the hook is resting on the ledge to pivot the hook away from the ledge to allow the lower hub to be lowered to allow the umbrella to collapse.

13. The umbrella of claim 10, wherein the cord is disposed over a pulley coupled with the hollow pole and is tension by downward movement of a lower end of the gas spring and/or downward movement of the lower hub.

14. The umbrella of claim 10, wherein downward movement of the lower hub raises a lower end of the gas spring to compress the gas spring.

15. The umbrella of claim 10, further comprising an upper fixture disposed on the hollow pole, the upper fixture comprising a second pulley and at least one ledge for a corresponding hook of the lower hub to interact with.

16. The umbrella of claim 10, the gas spring further comprising a lower fixture comprising a central hub and a plurality of spacers, each spacer extending from the central hub to a free end.

17. The umbrella of claim 16, wherein the lower fixture comprises the first pulley.

18. The umbrella of claim 10, further comprising a strap to retain the umbrella in a closed state.

19. The umbrella of claim 10, wherein the gas spring further comprises a hollow tube and a piston sized to fit within the hollow tube.

20. The umbrella of claim 19, wherein the gas spring further comprising a seal positioned between an inner diameter of the hollow tube and an outer diameter of the piston.

21. The umbrella of claim 10, further comprising an upper fixture disposed on the hollow pole, the upper fixture comprising a radial projection disposed on a lower portion, the lower hub comprising a radial recess disposed on an inner periphery of an upper portion, the radial projection configured to be disposed in the radial recess to limit rotation of the lower hub about the hollow pole.

22. The umbrella of claim 21, wherein the upper fixture comprises a plurality of radial projections disposed on a lower portion, the lower hub comprising a plurality of radial recesses disposed on an inner periphery of an upper portion, the plurality of radial projections configured to be disposed in the plurality of radial recesses to limit rotation of the lower hub about the hollow pole.

23. The umbrella of claim 10, further comprising a cord guide member disposed about a hollow tube of a gas spring of the lift assist assembly, the cord guide member comprising a plurality of projections configured to slide along an inner surface of the hollow pole.

24. An umbrella comprising:
a hollow pole;
a shade assembly coupled with an upper portion of the hollow pole, the shade assembly comprising:
an upper hub, a lower hub, a shade structure coupling the upper hub to the lower hub, the shade structure supporting a shade member, wherein the lower hub is moveable along the hollow pole;

a hook pivotably mounted in the lower hub, the hook configured to rest on a ledge of the hollow pole when the umbrella is open and to pivot away from the ledge to allow the umbrella to be closed, the pivoting of the hook being actuated by downward movement of a handle relative to an upper portion of the lower hub, wherein the handle extends downward from a lower portion of the lower hub, the handle being moveable downward relative to an upper portion of the lower hub when the hook is resting on the ledge to pivot the hook away from the ledge to allow the lower hub to be lowered to allow the umbrella to collapse, wherein the hook comprises a curved lower portion that is actuated by movement of a roller disposed in the handle; and a lift assist assembly disposed within the hollow pole, the lift assist assembly comprising a gas spring and a cord having a first end disposed within the hollow pole and a second end coupled with the lower hub, wherein when closing the umbrella, the cord applies a load to compress the gas spring, and wherein when opening the umbrella the gas spring applies a load to the lower hub by way of the cord.

* * * * *